US007020404B2

(12) United States Patent
Fukuda et al.

(10) Patent No.: US 7,020,404 B2
(45) Date of Patent: Mar. 28, 2006

(54) IMAGE FORMING APPARATUS WITH COLOR SHIFT SENSORS THAT ARE SHIELDED FROM TONER

(75) Inventors: Masahiro Fukuda, Tokyo (JP); Toshimasa Shiobara, Tokyo (JP); Takeshi Asaba, Tokyo (JP); Masanori Maekawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 162 days.

(21) Appl. No.: 10/648,397

(22) Filed: Aug. 27, 2003

(65) Prior Publication Data

US 2004/0042816 A1 Mar. 4, 2004

(30) Foreign Application Priority Data

Aug. 30, 2002 (JP) ..... 2002-253274
Oct. 17, 2002 (JP) ..... 2002-302794

(51) Int. Cl.
*G03G 15/00* (2006.01)

(52) U.S. Cl. ..... 399/49; 399/74; 399/98

(58) Field of Classification Search ..... 399/49, 399/74, 98, 99, 298, 299, 301–303
See application file for complete search history.

(56) References Cited

U.S. PATENT DOCUMENTS 5,517,283 A 5/1996 Hori et al.
6,219,508 B1 * 4/2001 Nagatomi et al. ..... 399/301
6,321,044 B1 * 11/2001 Tanaka ..... 399/49

FOREIGN PATENT DOCUMENTS

| | | |
|---|---|---|
| EP | 0 314 536 | 9/1988 |
| JP | 05-164694 | 6/1993 |
| JP | 2000-081739 | 3/2000 |
| JP | 2002-031919 | 1/2002 |
| JP | 2002-131997 | 5/2002 |

* cited by examiner

*Primary Examiner*—William J. Royer
(74) *Attorney, Agent, or Firm*—Rabin & Berdo, PC

(57) ABSTRACT

An image forming apparatus forms a toner image on a toner image bearing body and the toner image is transferred onto a recording medium. An image forming section forms the toner image on the toner image bearing body, which may be a transfer belt. A reading section optically reads the toner image formed on the image bearing body. A covering section is provided between the reading section and the toner image bearing body. The covering section can move between an opening position, where the covering section covers the reading section, and a closing position, where the covering section does not cover the reading section. A drive mechanism drives the covering section to move between the opening position and the closing position. An adjustment section adjusts the reading section when the covering section is at the closing position. The covering section includes a reflection member attached thereto.

25 Claims, 29 Drawing Sheets

IMAGE FORMING APPARATUS WITH COLOR SHIFT SENSORS THAT ARE SHIELDED FROM TONER

BACKGROUND OF THE INVENTION

1. Field of the Invention

The present invention relates to the correction of an output of a density sensor and a dust-proof mechanism for the density sensor and color shift sensors, which density sensor and color shift sensors are used in a color electrophotographic recording apparatus.

2. Description of the Related Art

A conventional color image forming apparatus incorporates image forming sections for the respective colors and a supporting member provided below a transfer belt that is in contact with these image forming sections. A left color shift sensor and a right color shift sensor are disposed on the supporting member and aligned in a direction transverse to the direction in which the transfer belt runs. The left color shift sensor and right color shift sensor detect positional errors among images of the respective colors at the left end and right end of a width of the transfer belt. A density sensor is disposed midway between the left and right color shift sensors. The sensors are located immediately below the transfer belt and directly face the transfer belt with nothing existing between the transfer belt and these sensors.

With such a conventional color electrophotographic recording apparatus, the upper surfaces of the color shift sensors and the density sensor are exposed. The upper surfaces attract dust, waste, and toner, so that toner adhering to the transfer belt may drop from the transfer belt onto the light-receiving surfaces of the sensors to prevent normal detection of light. Additionally, the output of the sensors varies from sensor to sensor, so that there are variations in sensor output even when the same object is measured.

SUMMARY OF THE INVENTION

An object of the invention is to solve the aforementioned drawbacks of the conventional apparatus.

An object of the invention is to provide an image-forming apparatus in which for example, reliable correction of color shift can be performed while also preventing increases in overall size and manufacturing cost of the image-forming apparatus.

An image forming apparatus forms a toner image on an image bearing body and transfers the toner image onto a recording medium.

The image forming apparatus includes an image forming section, a toner image bearing body, a reading section that reads the toner image formed on the image bearing body, a covering section, a drive mechanism, and an adjustment section. The covering section is provided between the reading section and the toner image bearing body and movable between a closing position where the covering section covers the reading section and an opening position where the covering section does not cover the reading section. The drive mechanism drives the covering section to move between the opening position and the closing position. The adjustment section adjusts the reading section when the covering section is at the closing position.

The covering section includes a reflection member attached thereto. The reading section includes a light emitting section that emits an amount of light to the reflection member and a light receiving section that receives light reflected from the reflection member. The adjustment section adjusts the amount of light in accordance with an output of the light receiving section that detects the reflection member.

The apparatus further includes a controller that controls the drive mechanism to drive the covering section. The controller controls the drive mechanism according to a detection output of the light receiving section that detects passage of an edge of the covering section. The reflection member has a first reflection coefficient and the image bearing body has a second reflection coefficient.

The apparatus further includes a fixing section and at least one of a first drive section, a second drive section, and a third drive section. The fixing section fuses the toner image transferred onto the recording medium into a permanent image. The first drive section drives the image forming section. The second drive section drives the toner image bearing body. The third drive section drives the fixing section. The drive mechanism is powered by one of the first drive section, the second drive section, and the third drive section to move the covering section between the opening position and the closing position.

The drive mechanism drives the covering section to move straight.

The drive mechanism includes a gear train that transmits a drive force from any one of the first drive section, the second drive section, and the third drive section to the covering section.

The covering section moves in a first direction to the opening position and in a second direction opposite to the first direction to the closing position. When a rotating member of one of the first drive section, the second drive section, and the third drive section rotates in a third direction, the covering section moves either in the first direction or in the second direction.

The fixing section includes a heater, and the drive mechanism is powered by the third drive section to move the covering section to the opening position before the heater reaches a predetermined temperature.

The fixing section includes a motor. When the toner image is fused, the motor rotates in a forward direction. When the covering section moves to the opening position, the motor rotates in a reverse direction.

The image forming apparatus further includes a cleaning member mounted to the covering section. When the drive mechanism drives the covering section to move between the opening position and the closing position, the cleaning member moves into contact engagement with the reading section to remove foreign matter from the reading section.

The image forming apparatus further includes a correction section that corrects at least one of a position on the image bearing body at which a toner image is formed and a density of the toner image formed on the image bearing body, the position and the density being corrected in accordance with an output of the reading section.

An image forming apparatus forms a toner image on an image bearing body and transfers the toner image onto a recording medium. The apparatus includes an image forming section, a toner image bearing body; a reading section, a covering section, a drive mechanism, and an adjustment section. The reading section reads the toner image formed on the toner image bearing body. The covering section is provided between the reading section and the toner image bearing body and movable between a closing position where the covering section covers the reading section and an opening position where the covering section does not cover the reading section. The drive mechanism drives the covering section to move between the opening position and the closing position. The adjustment section adjusts the reading section when the covering section is at the opening position.

The reading section includes a light emitting section that emits an amount of light to the reflection member and a light receiving section that generates an output in accordance with an amount of light received. The adjustment section adjusts the amount of light emitted from the light emitting section in accordance with the output of the light receiving section that detects light reflected by the toner image bearing body.

An image forming apparatus forms a toner image on an image bearing body and transfers the toner image onto a recording medium. The apparatus includes an image forming section, a toner image bearing body, a reading section, a covering section, a drive mechanism, and a cleaning member. The reading section reads the toner image formed on the toner image bearing body. The covering section provided between the reading section and the toner image bearing body and movable between a closing position where the covering section covers the reading section and an opening position where the covering section does not cover the reading section. The drive mechanism that drives the covering section to move between the opening position and the closing position. The cleaning member is mounted to the covering section. When the drive mechanism drives the covering section to move between the opening position and the closing position, the cleaning member moves into contact engagement with the reading section to remove foreign matter from the reading section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DESCRIPTION OF THE INVENTION

FIRST EMBODIMENT

Figure 1:
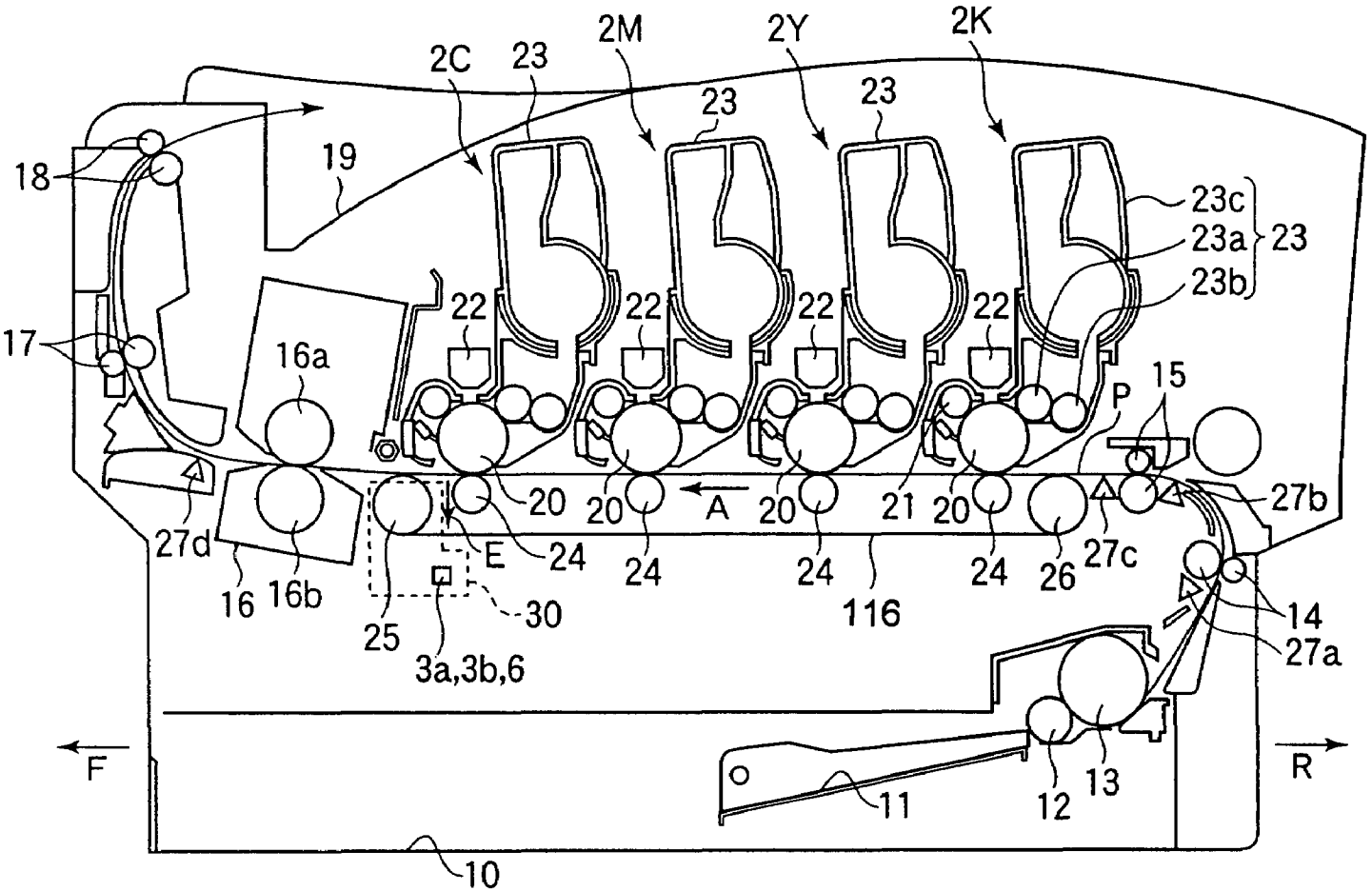
FIG. 1 illustrates schematically an image-forming apparatus according to a first embodiment of the invention.

FIG. 1 illustrates schematically an image-forming apparatus according to a first embodiment of the invention.

This image-forming apparatus forms color images by the use of electrophotography, and takes the form of a tandem type image forming apparatus that includes image-forming sections 2K, 2Y, 2M, and 2C for black, yellow, magenta, and cyan images. The image-forming sections 2K, 2Y, 2M, and 2C are aligned in this order along the direction of travel of recording paper P, as indicated by arrow A in FIG. 1.

Figure 25:
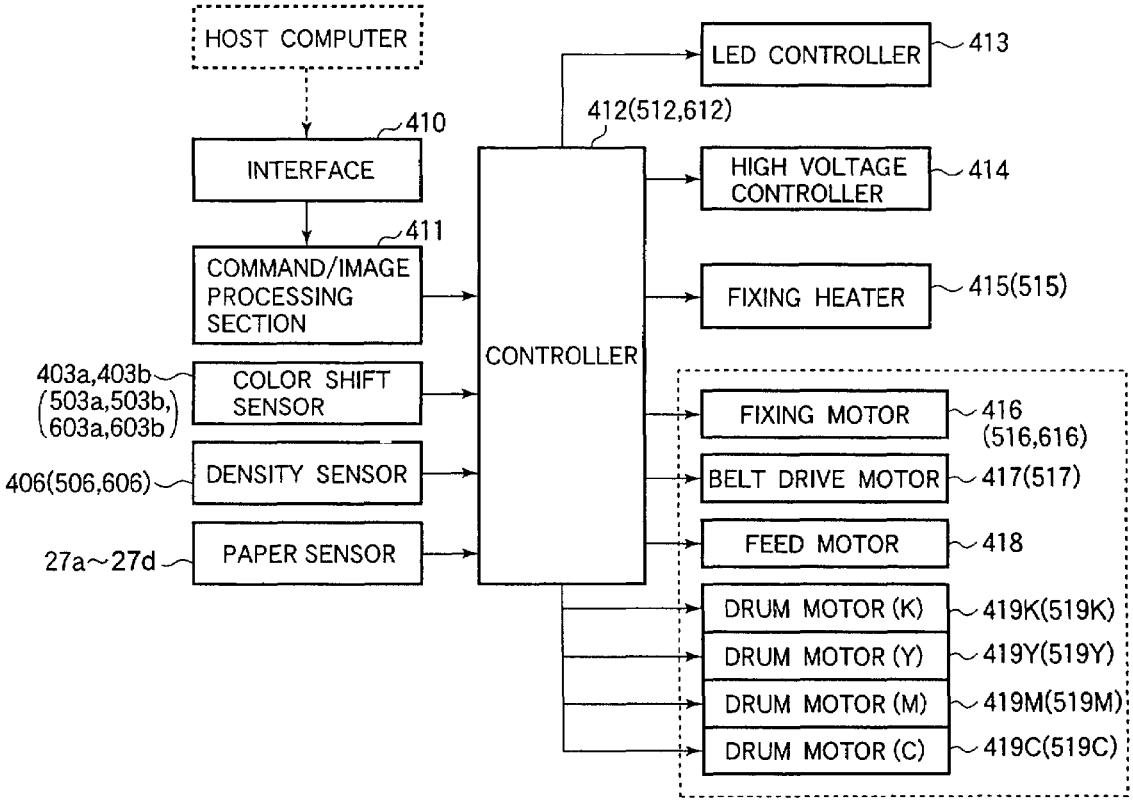
FIG. 25 is a block diagram, illustrating a control system for the image-forming apparatus.

The image-forming section 2K includes a photoconductive drum 20 driven in clockwise rotation by a drum motor 419K (FIG. 25). Disposed around the photoconductive drum 20 are a charging roller 21, an LED head 22, and a developing unit 23. The developing unit 23 incorporates a developing roller 23*a*, a toner-supplying roller 23*b*, and a toner chamber 23*c* therein. The toner chamber 23*c* holds black toner therein. There is provided a transfer roller 24, so that the recording paper P is sandwiched between the photoconductive drum 20 and the transfer roller 24.

The charging roller 21 charges the surface of the photoconductive drum 20 uniformly. The LED head 22 illuminates the charged surface of the photoconductive drum 20 selectively in accordance with image information. The light emitted from the LED head 22 dissipates charges in areas on the photoconductive layer of the photoconductive drum 20, leaving charges in non-exposed areas so as to form an electrostatic latent image as a whole. The developing unit 23 applies toner to the electrostatic latent image formed on the photoconductive drum 20, thereby forming a toner image. The transfer roller 24 supplies charges of an opposite polarity to the toner to the back surface of the recording paper P, thereby transferring the toner image from the photoconductive drum 20 onto the recording paper P.

The image-forming sections 2Y, 2M, and 2C are all configured in the same manner as the image-forming section 2K. The developing units 23 for the image-forming sections 2Y, 2M, and 2C hold yellow, magenta, and cyan toners, respectively.

A transfer belt 116 that carries the recording paper P thereon is a so-called endless belt entrained about rollers 25 and 26. The transfer rollers 24 for the image forming sections 2Y, 2M, and 2C are aligned in a line between the rollers 25 and 26. The rollers 25 and 26 rotate about parallel axes that extend in a direction transverse to the direction in which the transfer belt 116 runs. The roller 25 is a drive roller driven in rotation by a belt drive motor 417 (FIG. 25). When the drive roller 25 rotates, the transfer belt 116 runs in a direction shown by arrow A.

Disposed on the left of the drive roller 25 is a fixing unit 16 for pressurizing and heating the recording paper P to fuse the toner image transferred onto the recording paper P. The fixing unit 16 includes a fixing roller 16*a* that incorporates a fixing heater 415 (FIG. 25) therein, a pressure roller 16*b*, a fixing motor 416 (FIG. 25), and a mechanism (e.g. gear train) via which the drive force of the fixing motor 416 is transmitted to the fixing roller 16*a*. The fixing motor 416 generates a drive force for rotating the fixing roller 16*a*. When the fixing roller 16*a* is rotated, the recording paper P is pulled in between the fixing roller 16*a* and the pressure roller 16*b*. Disposed to the left of the fixing unit 16 are discharge roller pairs 17 and 18 that advance the recording paper P to a stacker 19.

A paper cassette 10 that holds a stack of the recording paper P therein is disposed at a lower portion of the image-forming apparatus.

Disposed to the right of the paper cassette 10 are a small-diameter auxiliary roller 12 and a large-diameter feed roller 13 that advance the recording paper P from the paper cassette 10. A feed motor 418 (FIG. 25) drives the auxiliary roller 12 and feed roller 13 in rotation. There is provided an inclined plate 11 that presses the leading edge of the top page of the stack of recording paper P against the auxiliary roller 12 and the feed roller 13. Transport roller pairs 14 and 15 are provided along a transport path in which the recording paper P is transported from the paper cassette 10 to the image forming section 2K.

The image-forming apparatus includes recording paper sensors 27*a*–27*d* that detect the passage of the recording paper P. The recording paper sensor 27*a* is disposed upstream of the transport roller pair 14 with respect to the direction of travel of the recording paper P, and the recording paper sensor 27*b* is disposed upstream of the transport roller pair 15. The recording paper sensor 27*c* is disposed upstream of the roller 26 and the recording paper sensor 27*d* is disposed downstream of the fixing unit 16.

Color shift sensors 3*a* and 3*b* are provided near the drive roller 25 and detect patterns (toner images) for optical color shift detection, transferred onto the belt 116 by the image-forming sections 2K, 2M, 2Y, and 2C. The color shift sensors 3*a* and 3*b* are disposed under the drive roller 25 and aligned in a direction transverse to the direction in which the transfer belt 116 runs. The color shift sensors 3*a* and 3*b* each include a light-emitting element and a light-receiving element. The light-emitting element illuminates the pattern formed on the transfer belt 116. The light-receiving element detects the light reflected from the pattern to output a voltage signal in accordance with the intensity of the reflected light.

A density sensor 104 (FIG. 2) is provided near the drive roller 25 and optically detects patterns for density detection, the patterns being transferred onto the transfer belt 116 by the image-forming sections 2K, 2Y, 2M, and 2C, respectively. The density sensor 104 is positioned under the drive roller 25 to oppose the middle of the transfer belt 116 and detects the patterns for density detection on the transfer belt 116, transferred by the image-forming sections 2K, 2Y, 2M, and 2C. The density sensor 104 includes a light-emitting element and a light-receiving element. The light-emitting element illuminates the patterns for density detection formed on the transfer belt 116. The light-receiving element detects the light reflected from the patterns to output a voltage signal in accordance with the intensity of the reflected light.

Figure 2:
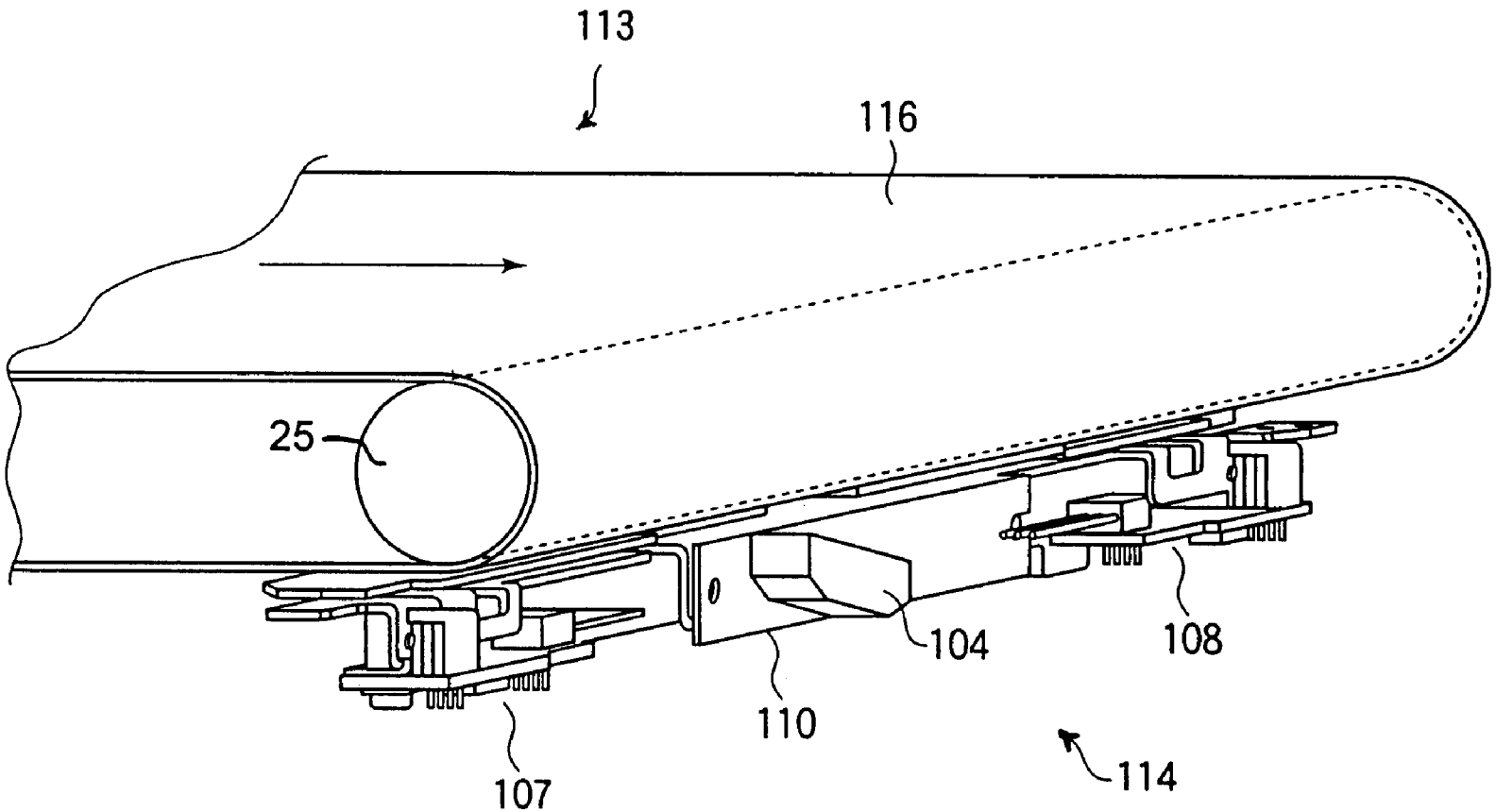
FIG. 2 is a fragmentary perspective view as seen from a fixing unit, illustrating a sensor unit and a belt unit.

FIG. 2 is a fragmentary perspective view as seen from the fixing unit 16, illustrating a sensor unit 114 and a belt unit 113.

Figure 3:
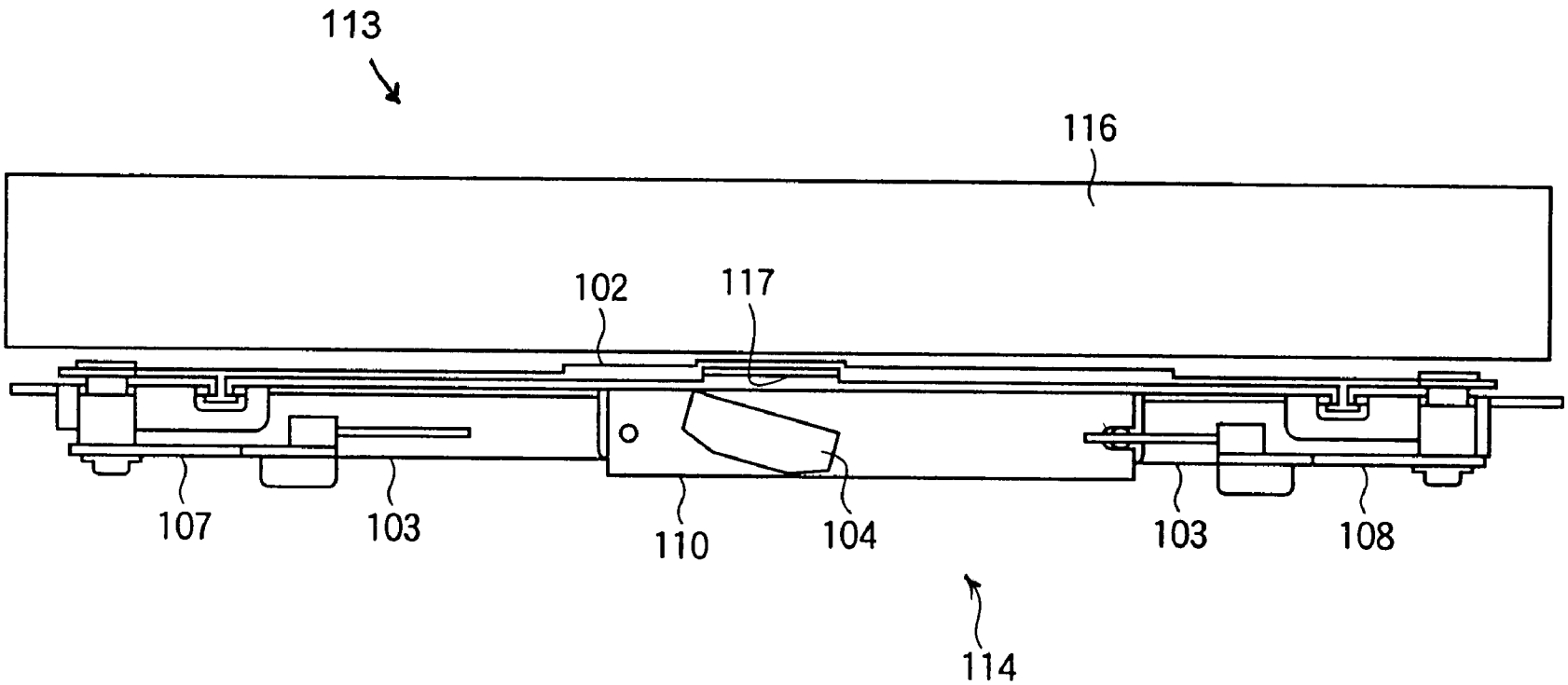
FIG. 3 is a front view as seen from the fixing unit, illustrating a sensor unit and a belt unit.

FIG. 3 is a front view as seen from the fixing unit 16, illustrating the sensor unit 114 and the belt unit 113.

The sensor unit 114 corresponds to a mechanism 30 in FIG. 1, and is disposed immediately below the belt unit 113 to oppose the transfer belt 116. Left and right circuit boards 107 and 108 are mounted symmetrically on the sensor unit 114, the left circuit board 107 being on the left end of the sensor unit 114 and the right circuit board 108 on the right end. The density sensor 104 is disposed in the middle of the sensor unit 114 and detects the density of an image. Provided over the density sensor 104 is a sheet 117 for use in the later described calibration of a sensors.

Figure 4:
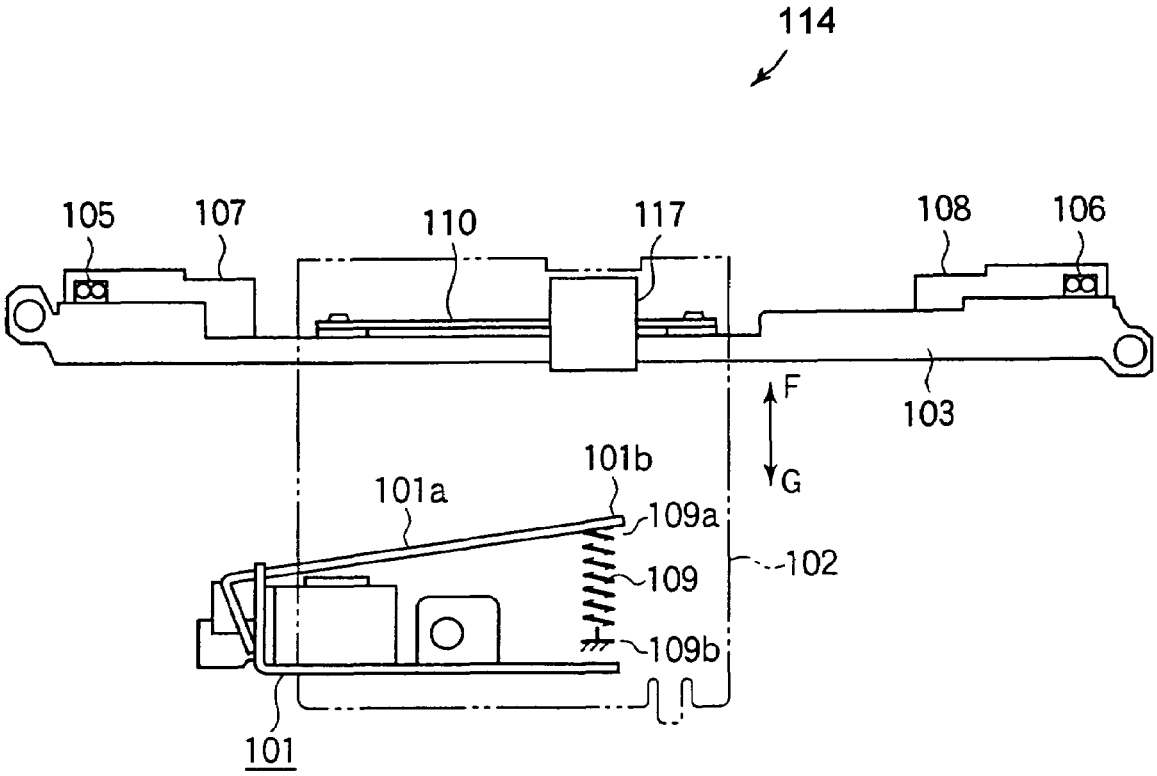
FIG. 4 is a top view of the sensor unit as seen from a transfer belt in a direction shown by arrow E in FIG. 1.

FIG. 4 is a top view of the sensor unit 114 as seen from the transfer belt 116 in a direction shown by arrow E in FIG. 1.

FIG. 4 illustrates a shutter 102 when it is closed. The left and right circuit boards 107 and 108 are securely mounted on a support member 103. A color shift sensor 105 and color shift sensor 106 are disposed on the left circuit board 107 and the right circuit board 108, respectively, and the light-emitting and light-receiving surfaces of the color shift sensors 105 and 106 are exposed upward. The density sensor 104 mounted on a board 110 is in the middle of the support member 103 and opposes the shutter 102. A solenoid 101 is fixed to a permanent part, not shown, of the image-forming apparatus. One end 109*b* of a compression spring 109 is fixed to a permanent part of the image-forming apparatus. Another end 109*a* of the compression spring 109 engages a lever 101*a* of the solenoid 101 to urge the shutter 102 in a direction shown by arrow F in FIG. 4. The shutter 102 is provided between the density sensor 104 and the transfer belt 116 and engages the free end 101*b* of the lever 101*a*, so that the shutter 102 is guided by a guide means, not shown, to slide in directions shown by arrows F and G. When the solenoid 101 is energized, the free end 101*b* of the lever

101*a* causes the shutter 102 to move in the G direction (FIG. 4) against the urging force of the compression spring 109.

Figure 5:
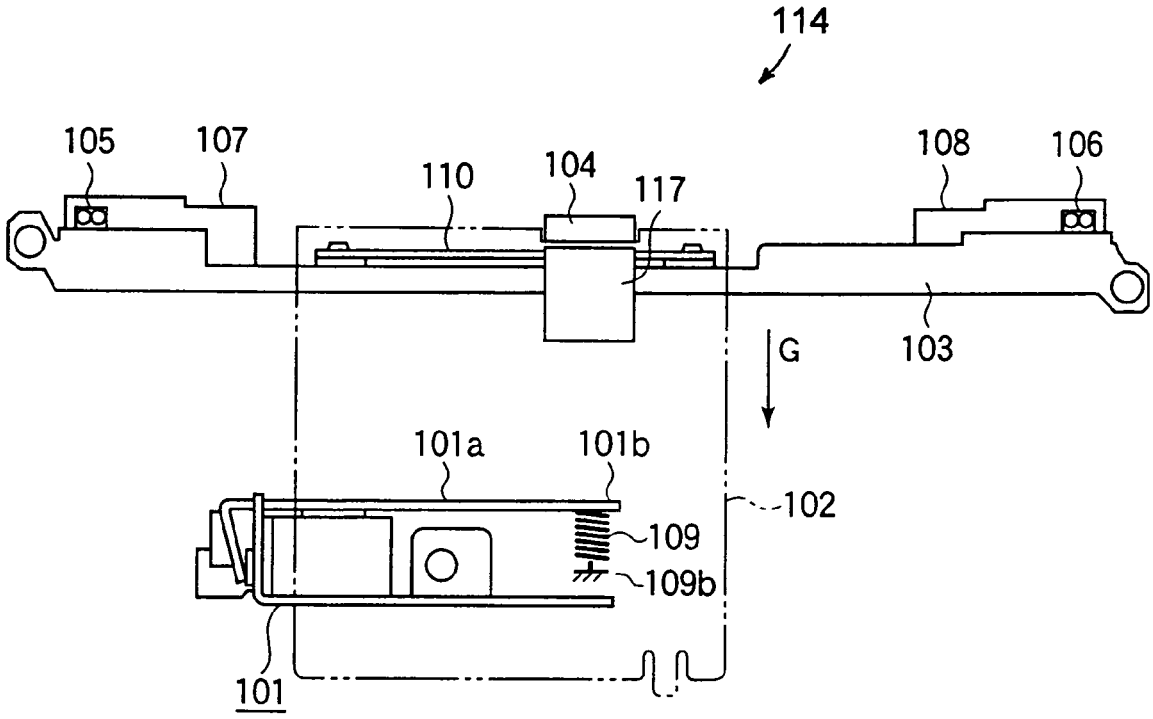
FIG. 5 is a top view of the sensor unit as seen from the transfer belt in the E direction (FIG. 1), illustrating a shutter when it is open.

FIG. 5 is a top view of the sensor unit 114 as seen from the transfer belt 116 in the E direction (FIG. 1), illustrating the shutter 102 when it is open.

When the image-forming apparatus is turned on, the belt unit 113 over the shutter 102 is driven. A certain length of time after power-up of the image-forming apparatus, the solenoid 101 is energized to attract the lever 101*a* which in turn moves to a position shown in FIG. 5. The movement of the lever 101*a* causes the shutter 102 to move in the G direction, so that the density sensor 104 is exposed.

The sheet 117 is attached to the surface of the shutter 102 that opposes the density sensor 104, and used as a reference reflection member for calibrating the density sensor 104. When the density sensor 104 detects the sheet 117, the density sensor 104 generates an output, which in turn is used as a reference output.

Figure 6A:
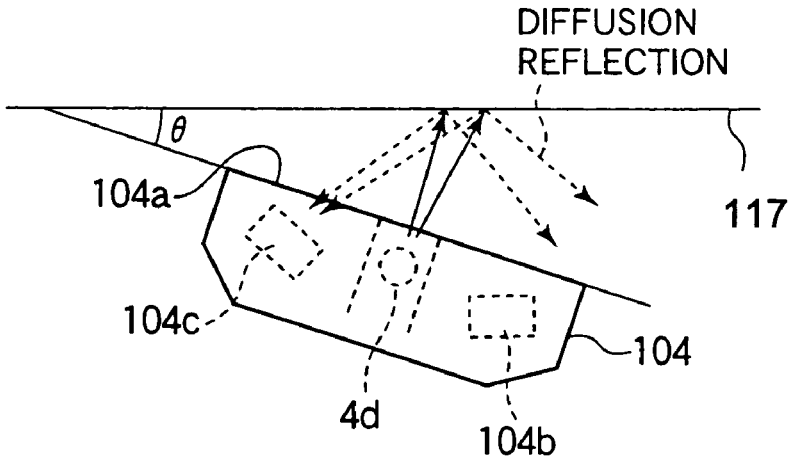
FIG. 6A illustrates the direction of travel of light emitted from a density sensor when the color calibration is performed.

FIG. 6A illustrates the direction of travel of light emitted from the density sensor 104 when color calibration is performed.

For color calibration, the shutter 102 is closed so that the sheet 117 opposes the density sensor 104. In the embodiment, the density sensor 104 has an LED 4*d* that functions as a light source. In color calibration, the light (depicted in solid lines) emitted from the LED is reflected by the sheet 117. The density sensor 104 is mounted such that the surface 104*a* of the density sensor 104 makes an angle θ with the surface of the sheet 117. The reflective material of the sheet 117 that operates as a reference reflector for color calibration is Munsell color chip N6.

Figure 6B:
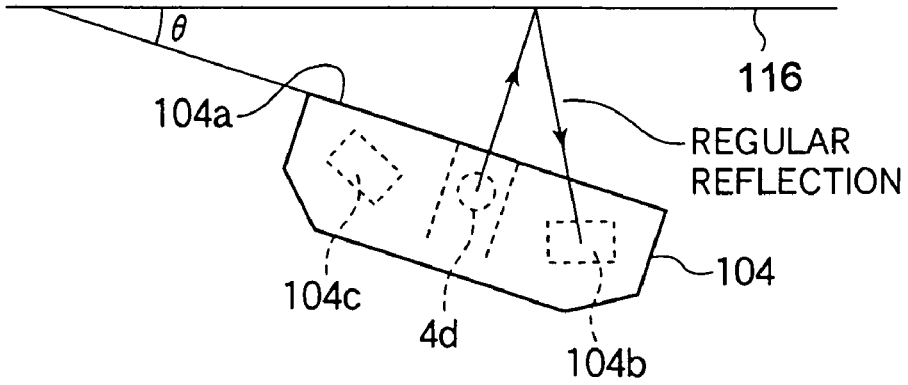
FIG. 6B illustrates the direction of travel of light emitted from the density sensor when black calibration is performed.

FIG. 6B illustrates the direction of travel of light emitted from the density sensor 104 when black calibration is performed.

For black calibration, the shutter 102 is opened so that the density sensor 104 opposes the transfer belt 116. In this case, too, the surface 104*a* of the density sensor 104 makes an angle θ with the surface of the transfer belt 116. Thus, the light emitted from the light source is reflected back by the surface of the transfer belt 116 into a black sensor 104*b*. The transfer belt 116 is a resin film of, for example, polyimide and has a smooth, glossy surface.

The transfer belt 116 has a smooth, glossy surface that is difficult to produce diffusion reflection and not suitable for color calibration. In contrast, the sheet 117 is easy to produce diffusion reflection and therefore is employed for color calibration.

Figure 7A:
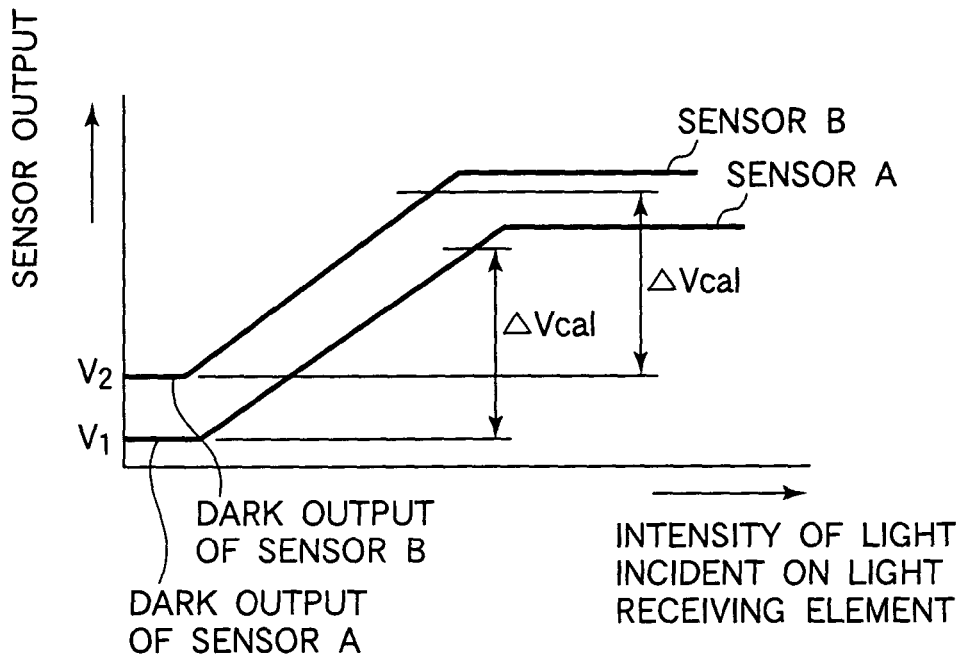
FIGS. 7A and 7B illustrate the relationship between the light input to the density sensor and the output from the density sensor.
Figure 7B:
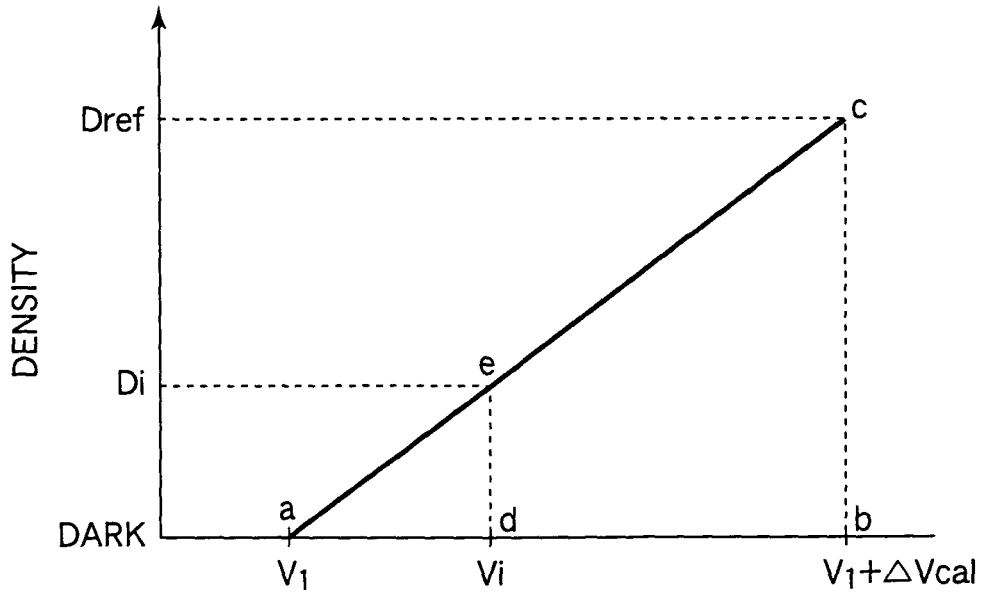

FIGS. 7A and 7B illustrate the relationship between the light input to the density sensor 104 and the output from the density sensor 104. When the density sensor 104 detects the density of an image, the light emitted from the LED is reflected back by the image formed on the transfer belt 116, and then detected by a light-receiving element of the density sensor 104. Thus, the output signal of the density sensor 104 is an analog signal substantially proportional to the density of the image. The lower the density (i.e., close to white), the larger the sensor output since the amount of reflected light is larger. The higher the density (i.e., close to black), the smaller the sensor output. A controller 118 (FIG. 9) receives an analog signal from the density sensor 104 and converts the received analog signal into a digital signal, thereby acknowledging the density of the image. However, the temperature characteristic of the output of the density sensor 104 varies from sensor to sensor. For example, as shown in FIG. 7A, sensor A and sensor B of the same model may generate outputs of different values even when they detect the same object image. The variations in the output of the density sensor 104 can be attributed to, for example, variations in the characteristics of sensor, differences in ambient temperature, and mounting errors of the density sensor 104. In order to detect the density of an image accurately, it is necessary to calibrate the output of the density sensor 104.

Figure 8:
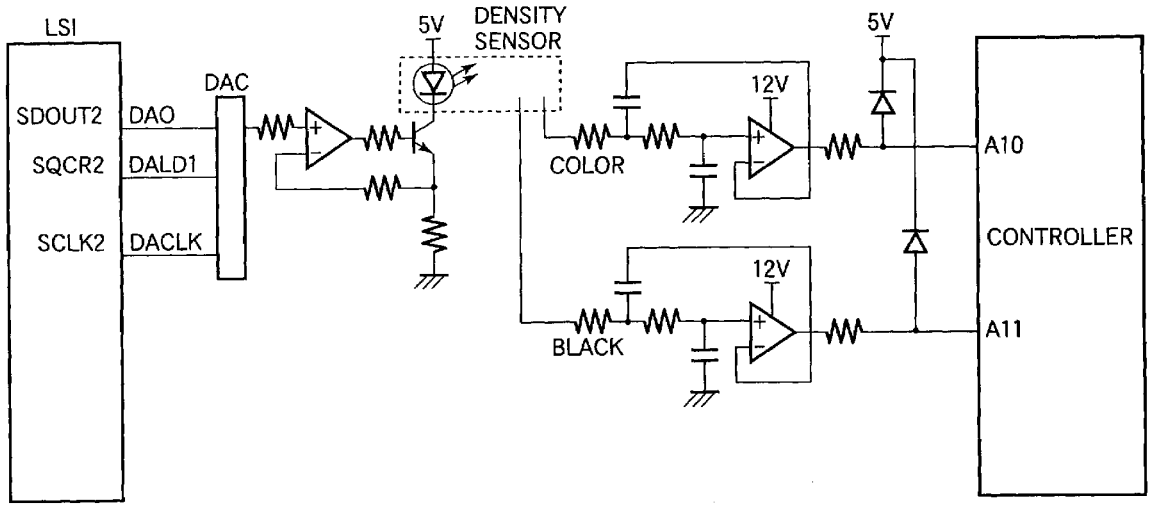
FIG. 8 illustrates a configuration of a density detecting circuit.

FIG. 8 illustrates a configuration of a density detecting circuit. The LED in the density sensor 104 radiates light and the light is reflected back by an image formed on the transfer belt 116 into the light-receiving section of the density sensor 104. The light-receiving section includes two systems, one for color images and one for black images. An LSI provides a digital data DAO to a digital-to-analog converter DAC upon clocks and loads the digital data DAO into the DAC upon a loading signal DALD1. The current through the LED is set in accordance with the digital data DAO. The digital-to-analog converter DAC produces an analog signal from the input digital signal and outputs the analog signal to the LED-driving circuit. The outputs of the density sensor 104 are read into a 10-bit ADC (channel 0) of a CPU through a low pass filter based on an OPAMP. The digital-to-analog converter DAC produces an 8-bit digital data DAO capable of setting the LED current in 256 different levels (0–4.5 volts). The upper limit of the setting is 4.5 volts. The relationship between a setting and a corresponding output voltage is such that Vout=(4.5×DAC)/256. When the output is maximum, the setting of D/A is given by (4.5/5)×256≅230. In other words, when the output is maximum, the setting of DAC is 230 in decimal, which is equal to $E6^H$ in hexadecimal.

The output of the density sensor 104 is calibrated as follows: The digital signal output from the digital-to-analog converter DAC is changed to change the amount of light emitted from the LED. The light emitted from the LED is reflected back by the sheet 117 in color calibration and by the transfer belt 116 in black calibration, and then received by the density sensor 104. The density sensor 104 in turn provides a detection signal in the form of an analog signal to the controller 118. The output of the digital-to-analog converter DAC is increased in increments of $OA^H$ until the output of the density sensor 104 increases from Vo to $Vo+\Delta VCAL\pm V_M$, the Vo being a sensor output beyond which the LED starts to light up. When the output of the density sensor 104 reaches $Vo+\Delta VCAL\pm V_M$, the output of the digital-to-analog converter DAC is recorded. Referring to FIG. 7A, the output $Vo+\Delta v_{cal}$ is a substantially upper limit of the sensor output that can change linearly, but the value of $\Delta V_{cal}$ may be selected to be somewhat smaller. In this manner, the calibration operation determines the current through the LED such that the output $Vo+\Delta v_{cal}$ is obtained. The controller 118 records the digital output of the digital-to-analog converter DAC that corresponds to this LED current. When the apparatus is normally operated, the digital output is used to energize the LED. In other words, the output of the digital-to-analog converter DAC corresponding to $Vo+\Delta V_{cal}$ is used as a reference to energize the LED so that the LED emits a reference amount of light when the density of an image formed on the transfer belt 116 is detected. As described above, the calibration operation determines a sensor output Vo for a completely dark condition and a reference sensor output $Vo+\Delta V_{cal}$ for the reference calibration sheet 117. Thus, when the density of an image is detected, the density of the image can be determined as a relative value to that of the reference calibration sheet 117. The density of the image can be explained as follows:

Referring to FIG. 7B, we obtain Eq. (1).

$$ab/cb=ad/ed \quad (1)$$

therefore, we obtain Eq. (2)

$$\{(Vo+\Delta V_{cal})-V1\}/D_{ref}=(Vi-V1)/D_i \quad (2)$$

where $D_{ref}$ is the density of the reference calibration sheet 117 and $D_i$ is the density of an image. Therefore, the following relation can be derived.

$$D_i=\{(Vi-V1)/\Delta V_{cal}\}D_{ref} \quad (3)$$

Therefore, irrespective of variations of the output characteristics such as dark output and the slope of the graph of sensor output versus amount of light of the density sensor 104, the linear portion of the sensor output characteristic can be effectively used to accurately detect the density of an image.

Figure 9:
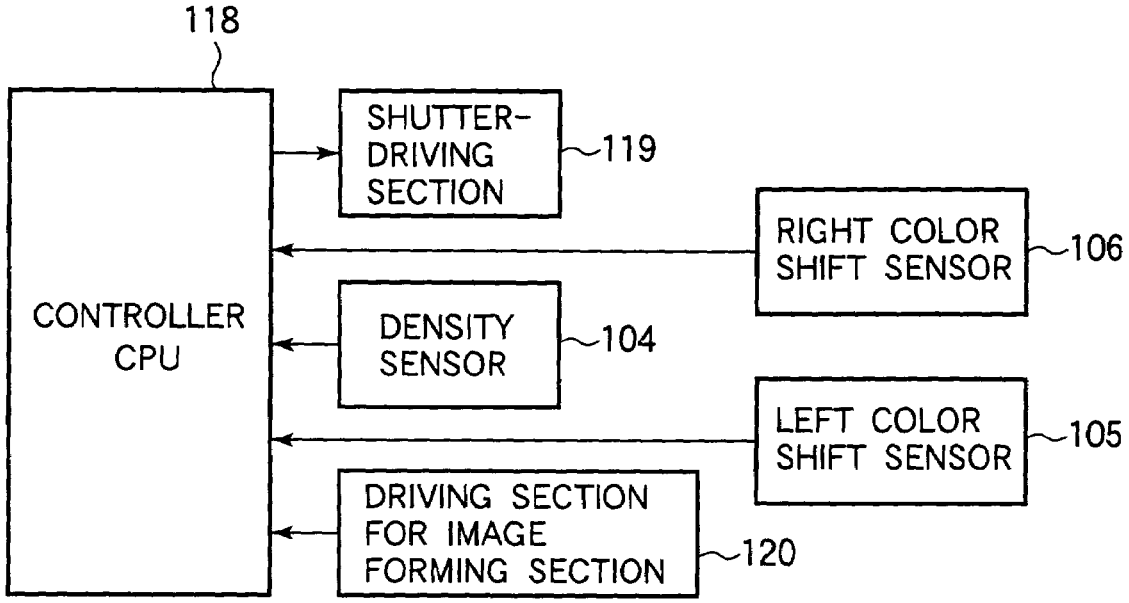
FIG. 9 illustrates a control block of the present invention.

FIG. 9 illustrates a control block of the present invention. The controller 118 in the form of, for example, a CPU, executes a program that controls the overall operation of the image-forming apparatus. The controller 118 sends a control signal to a shutter driving section 119 so as to open and close the shutter 102 by means of the solenoid 101 in FIGS. 4 and 5. The controller 118 receives the detection signal from the density sensor 104 in FIG. 5 and performs later described calibration and density correction. Based on the detection signals outputted from the left and right color shift sensors 105 and 106, the controller 118 controls the driving section 120 of the image-forming section to correct left and right color shifts. After calibration or density correction, a cleaning blade removes the toner from the transfer belt 116 and the controller 118 sends control signals to the image-forming sections K, Y, M, and C, respectively, to carry out a printing operation.

Figure 10:
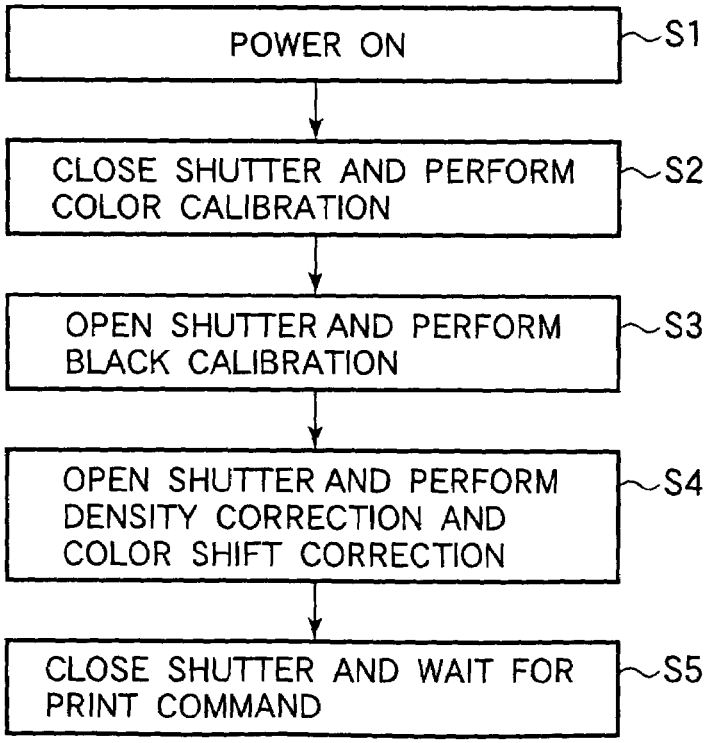
FIG. 10 is a flowchart that illustrates the overall operation of the image-forming apparatus according to the invention.

FIG. 10 is a flowchart that illustrates the overall operation of the image-forming apparatus according to the invention. At step S1, the apparatus is turned on. At step S2, the color calibration of the density sensor 104 is performed with the shutter 102 closed, thereby eliminating the output errors due to the variation in sensitivity among density sensors.

Then, the black calibration of the density sensor 104 is performed with the shutter 102 open, thereby eliminating the output errors due to the variations in sensitivity among density sensors. At step S3, the density correction is performed with the shutter 102 open. In other words, a reference toner image is formed on the transfer belt 116 and then the density sensor 104 detects the density of the reference toner image. With reference to the detection output of the density sensor 104, the conditions for forming images are changed to correct image density, thereby setting a desired image density. Likewise, the left and right color shifts can also be corrected at step S4. In other words, the toner images of the respective colors are formed in superposition on the transfer belt 116 and detected by the color shift sensors 105 and 106 mounted on the opposed ends of the support member 103. The positional errors between the respective toner images are determined by using the detected amount of color shift. In accordance with the positional errors, the timings at which images are formed by the image forming sections are adjusted. This completes color shift correction. At step S5, the shutter 102 is closed and then the program waits for a print command.

As described above, the shutter 102 on which the sheet 117 for color calibration is attached is driven to slide above the density sensor 104 between the transfer belt 116 and the density sensor 104. Thus, when the density correction of an image formed on the transfer belt 116 is performed, the shutter 102 can be readily moved so that the density sensor 104 directly faces the transfer belt 116. This allows smooth and accurate density correction of the image formed on the transfer belt 116.

Figure 11:
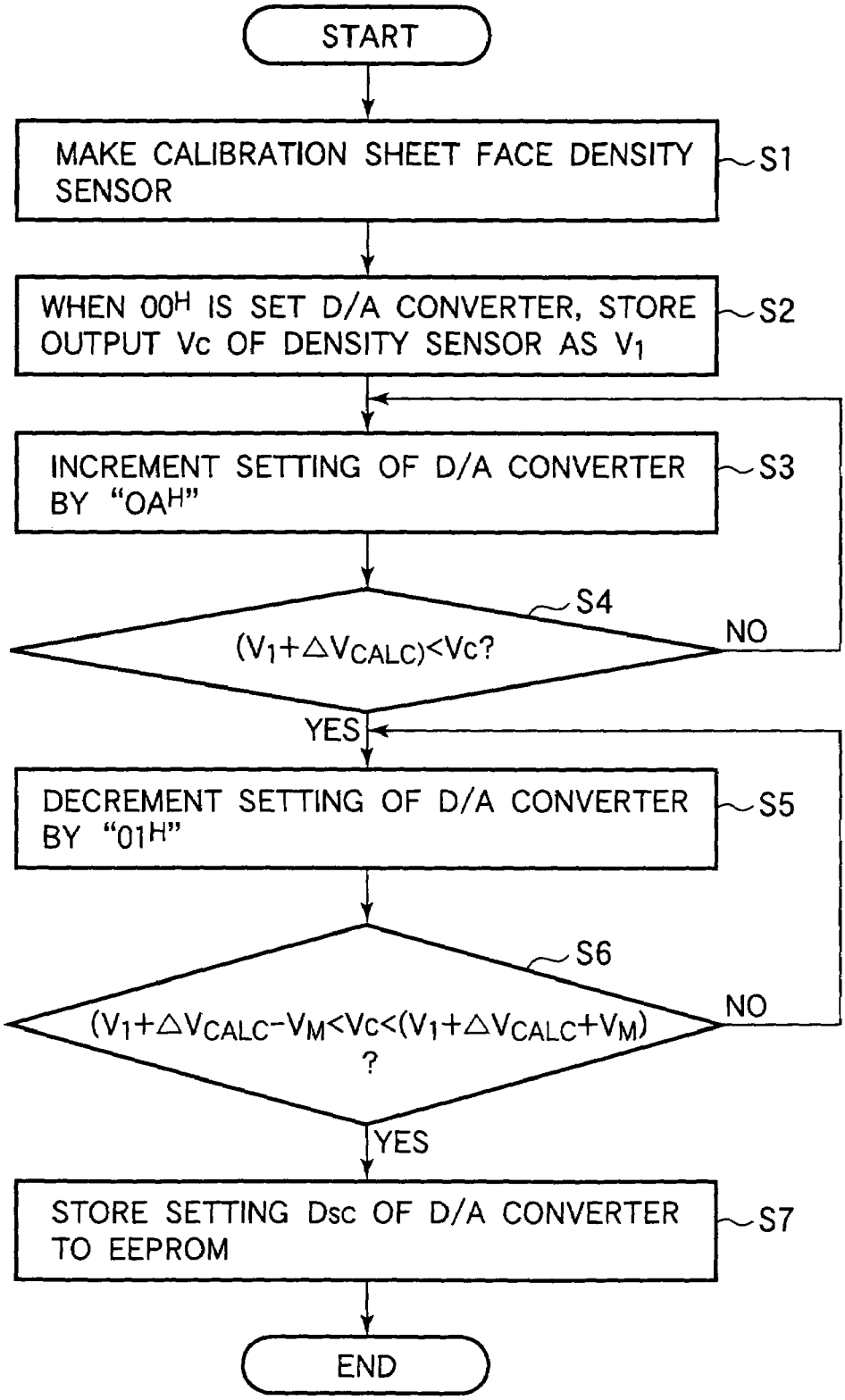
FIG. 11 is a flowchart that illustrates the procedure for calibrating the density sensor when color toners are used.

FIG. 11 is a flowchart that illustrates the procedure for calibrating the density sensor 104 when color toners are used.

Figure 12:
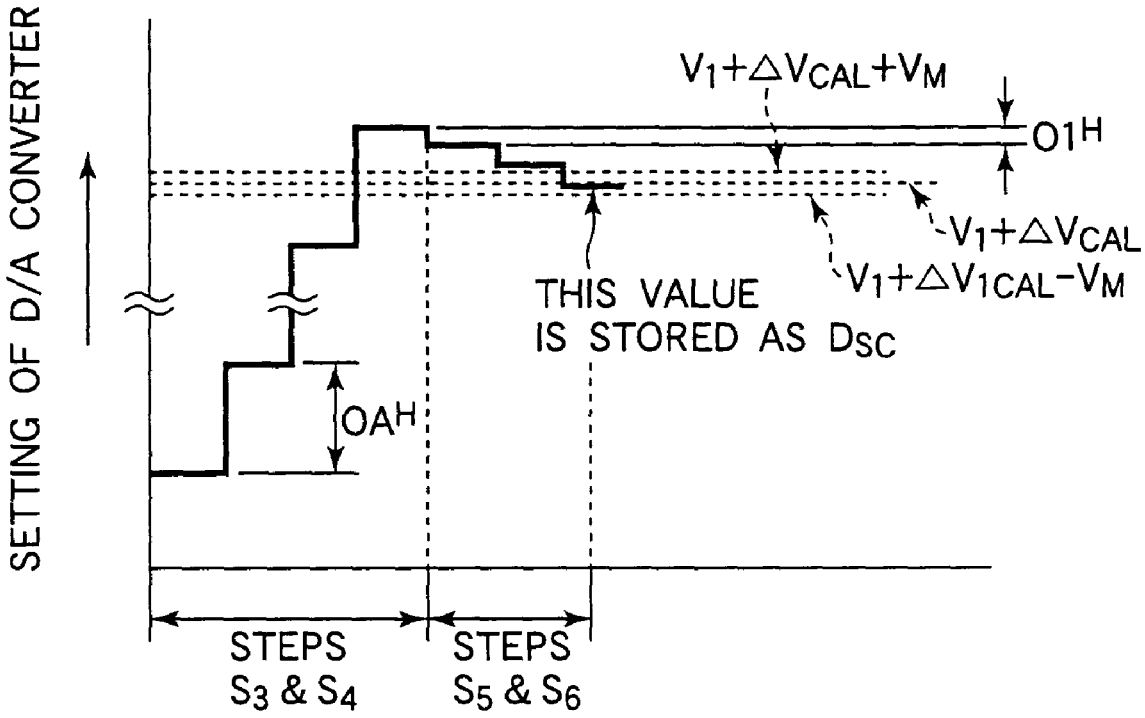
FIG. 12 illustrates the relationship between the individual steps in the calibration procedure and the settings of a digital-to-analog converter.

FIG. 12 illustrates the relationship between the individual steps in the calibration procedure and the settings of the digital-to-analog converter DAC.

In order to avoid adverse effects of noise, calibration is performed with the motors stopped. The output of the density sensor 104 generates a sensor output Vc for color toners and Vb for black toner. Color calibration is performed using the sheet 117 in the form of Munsell color chip N6. Black calibration is performed using the surface of the transfer belt 116 as a reference.

By way of example, color calibration will be described with reference to sensor A in FIG. 7A. At step S1 in FIG. 11, the image-forming apparatus is tuned on and the sheet 117 is moved to a position where the sheet 117 opposes the density sensor 104. The sheet 117 is attached to the back surface of the shutter 102 and therefore when the shutter 102 is closed, the density sensor 104 can detect the density of the sheet 117. At step S2, the controller 118 outputs a value of $00^H$ to the digital-to-analog converter DAC, the value $00^H$ being a value at which the LED of the density sensor 104 does not light up (dark output). The output Vc of the density sensor 104 for the value $00^H$ is recorded as V1. At steps S3 and S4, the setting of the digital-to-analog converter DAC is increased in increments of $OA^H$ until $V_C>V_1+\Delta V_{CALC}$. At steps S5 and S6, the setting of the digital-to-analog converter DAC is decremented by $01^H$ until $Vc=V_1+\Delta V_{CALB}\pm V_M$. $V_M$ is a later described calibration margin. At step S7, the setting $D_{sc}$ of the DAC when Vc becomes $V1+\Delta V_{CALC}\pm V_M$ is stored in the EEPROM. When the density of a color image is to be measured, the setting $D_{sc}$ is output to energize the LED in the density sensor 104. Because the sheet 117 is used as a common sheet to the respective colors, the sheet 117 should be a neutral color, e.g., gray.

By way of example, black calibration will now be described with reference to sensor A in FIG. 7A.

Figure 13:
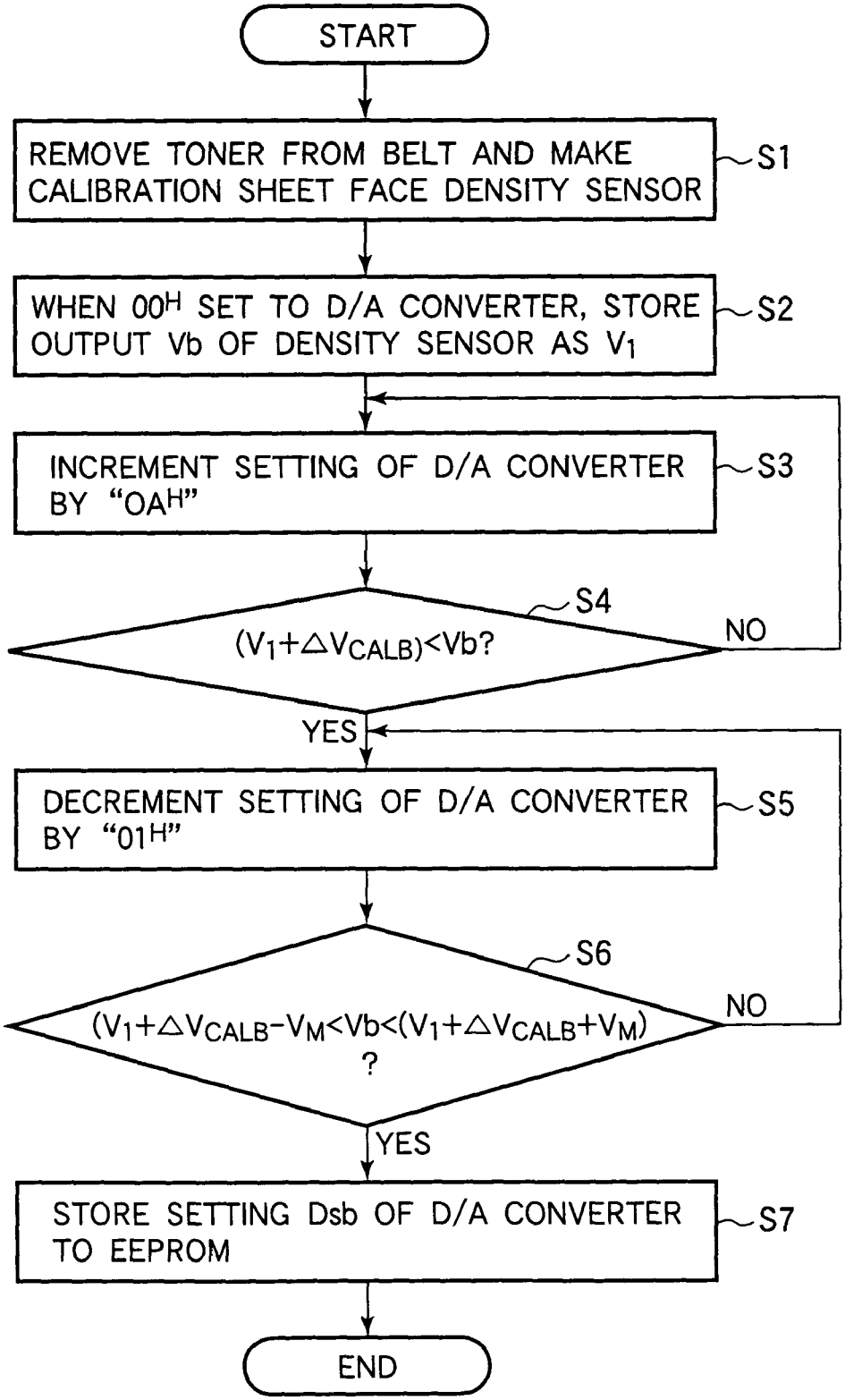
FIG. 13 is a flowchart, illustrating the procedure for calibrating the density sensor when black toner is used.

FIG. 13 is a flowchart, illustrating the procedure for calibrating the density sensor 104 when black toner is used.

At step S1, a cleaning blade in FIG. 1 scrapes off the toner adhering to the transfer belt 116. The shutter 102 is opened so that the density sensor 104 opposes the surface of the transfer belt 116. The surface of the transfer belt 116 is made of a highly reflective material to serve as a reference for calibration. At step S2, when the value $00^H$ is set to the DAC, the output Vb of the density sensor 104 is V1 and is stored. At steps S3 and S4, the setting of the DAC is increased in the increments of $OA^H$ until $V_b>V_1+\Delta V_{CALB}$. $\Delta V_{CALB}$ is a range in which the output of the density sensor 104 changes linearly from a dark output V1 to an output just before the output Vb is saturated. Steps S5 and S6, the setting of the digital-to-analog converter DAC is decremented by $01^H$ until $V_b>V_1+\Delta V_{CALB}\pm V_M$. At step S7, the setting $D_{sb}$ of the DAC when Vb becomes $V1+\Delta V_{CALB}\pm V_M$ is stored in the EEPROM. When the density of a black toner is to be measured, the setting $D_{sb}$ is output to energize the LED in the density sensor 104.

The image density varies depending on the environmental conditions such as temperature and humidity. Thus, the density correction needs to be carried out to adjust the density of the image to a predetermined level irrespective of the environmental conditions. For this purpose, a density-measuring pattern is printed on the transfer belt 116 periodically and the density of this pattern is measured. If the density of an image changes overtime or changes due to changes in environmental operating conditions, the developing voltage and the amount of light emitted from the LED head 22 are also changed to adjust the density of the image.

The density sensor 104 (e.g., GP2TC2, available from Sharp) used in the embodiment incorporates an infrared LED and two photo diodes for receiving light. As shown in FIGS. 6A and 6B, the two photo diodes are mounted at angles such that the photo diodes can receive efficiently regular reflection (black toner) coming from the transfer belt 116 and diffusion reflection (colored toners) coming from the sheet 117.

Figure 14:
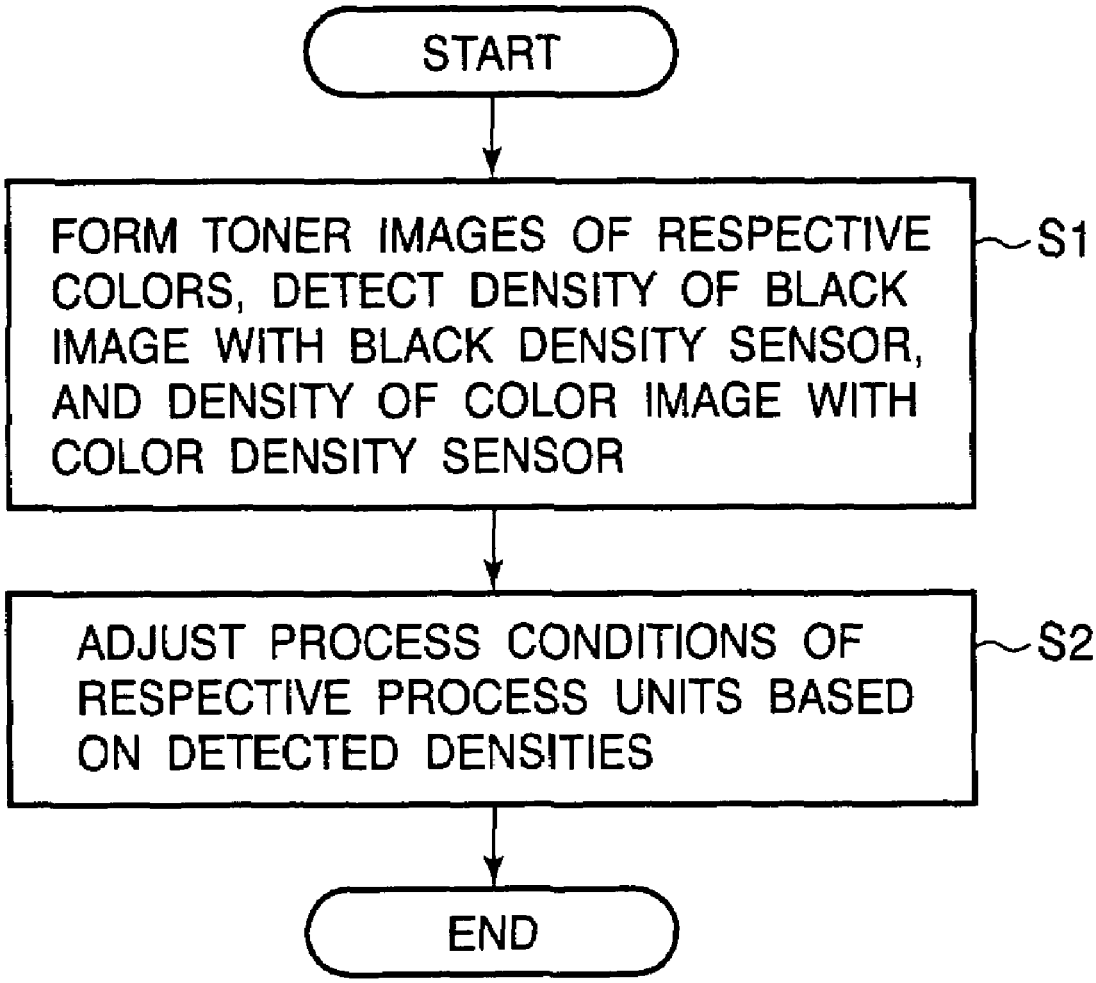
FIG. 14 is a flowchart, illustrating the procedure for performing density correction.

FIG. 14 is a flowchart, illustrating the procedure for performing density correction.

At step S1, toner images of the respective colors are formed on the transfer belt 116 in sequence. The black sensor 104*b* detects the density of a black toner image, and the color sensor 104*c* detects the density of a colored toner image. At step S2, based on the detected density, the image forming conditions for the respective image-forming section is changed to correct the density of a corresponding toner image, thereby obtaining a desired density level. The image-forming conditions can be changed by, for example, adjusting the developing bias and the amount of light that the LED head 22 radiates. The amount of light can be adjusted most readily because adjustment of the amount of light for exposure does not affect any other image-forming conditions.

Figure 15:
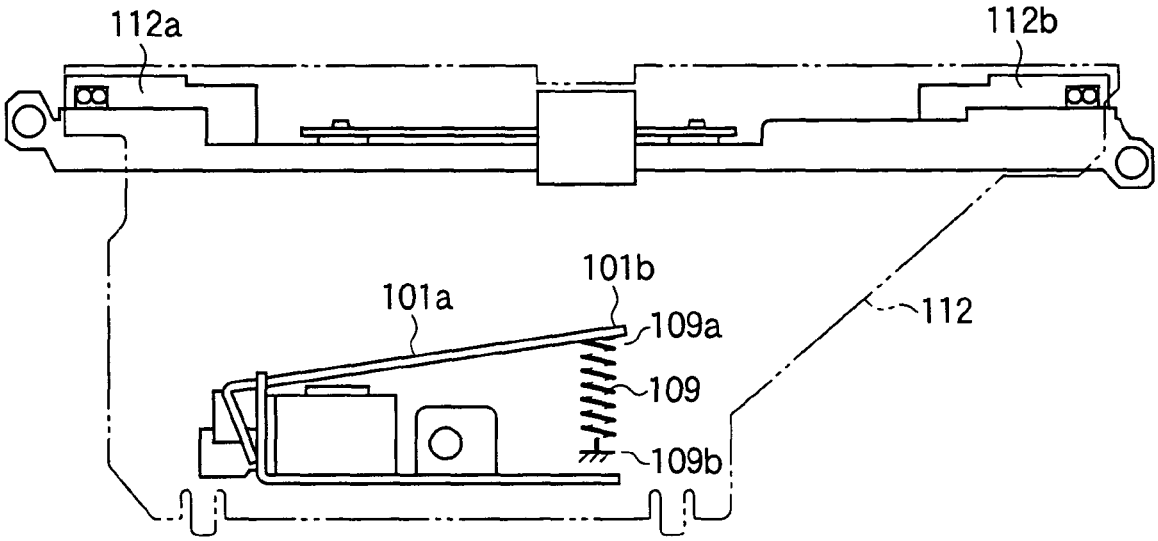
FIGS. 15 and 16 are top views, illustrating a modification to the first embodiment.
Figure 16:
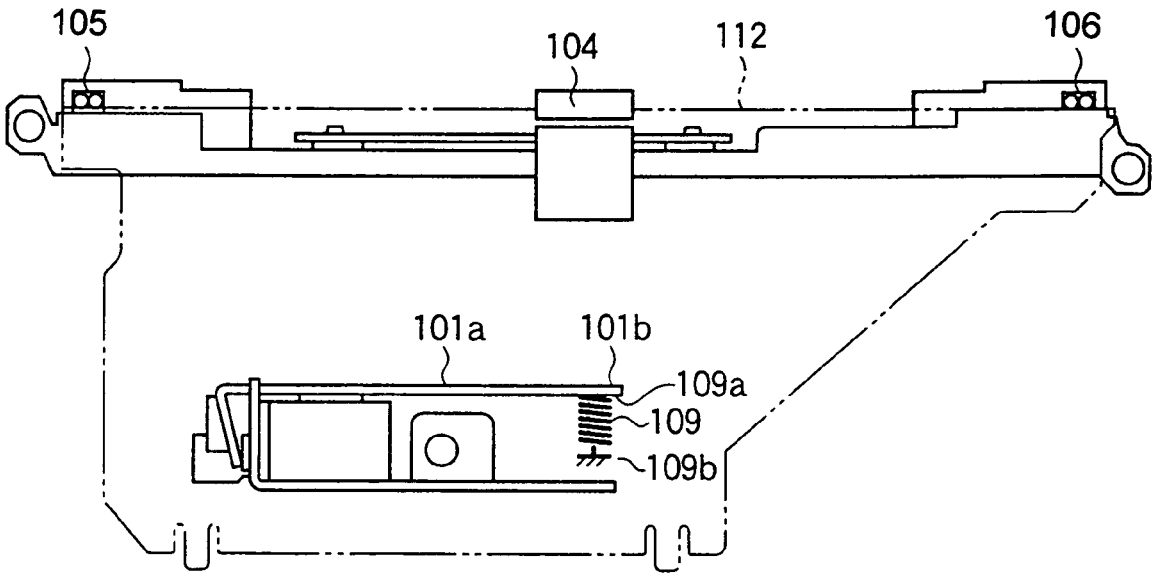

FIGS. 15 and 16 are top views, illustrating a modification to the first embodiment.

The modification differs from the first embodiment in the shape of a shutter 112. The rest of the configuration of the modification is the same as the first embodiment and thus the description thereof is omitted. In other words, when the shutter 112 is closed, the opposed end portions 112*a* and 112*b* of the shutter 112 cover the left color shift sensor 105 and the right color shift sensor 106, respectively. When the image forming apparatus is turned on, the solenoid 101 is energized to attract the lever 101*a*, thereby opening the shutter 112. Then, the density correction and color shift correction are performed. After the density correction and color shift correction, the solenoid 101 is de-energized to close the shutter 112.

According to the aforementioned modification, when the shutter 112 is closed, the opposed end portions 112*a* and 112*b* cover the left color shift sensor 105 and the right color shift sensor 106, respectively, thereby preventing the toner particles adhering to the transfer belt 116 from falling onto the surfaces of the color shift sensors 105 and 106.

SECOND EMBODIMENT

Figure 17:
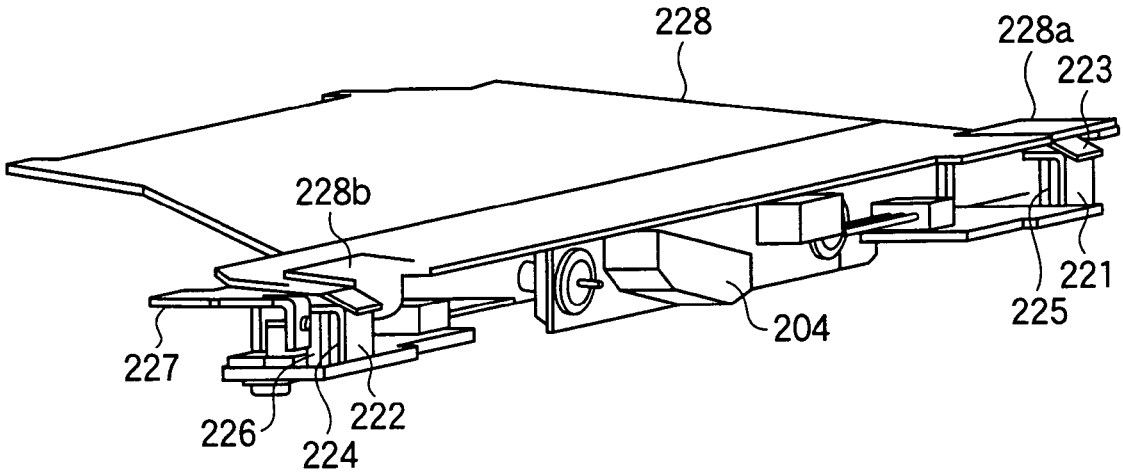
FIG. 17 is a perspective view, illustrating a second embodiment.

FIG. 17 is a perspective view, illustrating a second embodiment.

Figure 18:
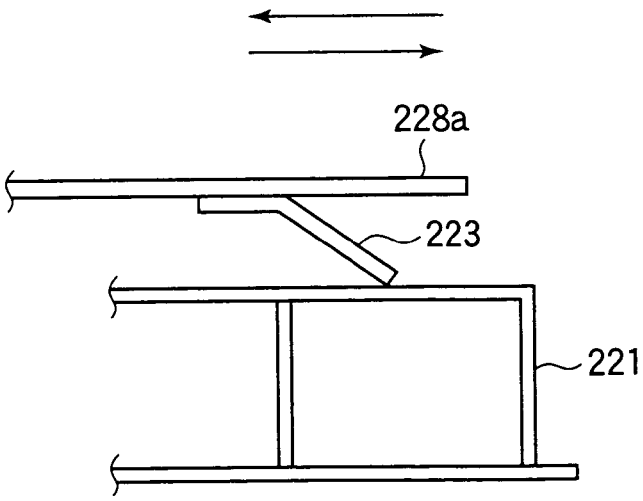
FIG. 18 is a side view, illustrating the positional relationship between a blade and sensor cover.

FIG. 18 is a side view, illustrating the positional relationship between a blade and sensor cover.

A left sensor cover 221 covers a left color shift sensor 225 and a right sensor cover 222 covers a right color shift sensor 226. The left sensor cover 221 and right sensor cover 222 are molded products of transparent plastics and are fastened to a support member 227.

A shutter 228 has opposed end portions 228*a* and 228*b* that face the sensor covers 221 and 222, respectively. A left blade 223 is fixed to the end portion 228*a* and extends toward the sensor cover 221 at an angle with the end portion of the shutter 228. The free end of the left blade 223 engages the sensor cover 221 at an angle with the sensor cover 221 and presses the sensor cover 221 resiliently. A right blade 224 is fixed to the end portion 228*b* and extends toward the sensor cover 222 at an angle with the end portion 228*b*. The end of the right blade 224 engages the sensor cover 222 at an angle with the sensor cover 222 and presses the sensor cover 222 resiliently. When the image-forming apparatus is turned on, the shutter 228 slides to perform color shift correction just as in the first embodiment. Every time the shutter 228 is opened and then closed, the left blade 223 and right blade 224 rub the surfaces of the left sensor 221 and right sensor 222, respectively. The sliding operation of the left and right blades 223 and 224 removes toner particles deposited on the surfaces of the color shift sensors 225 and 226.

THIRD EMBODIMENT

Figure 19:
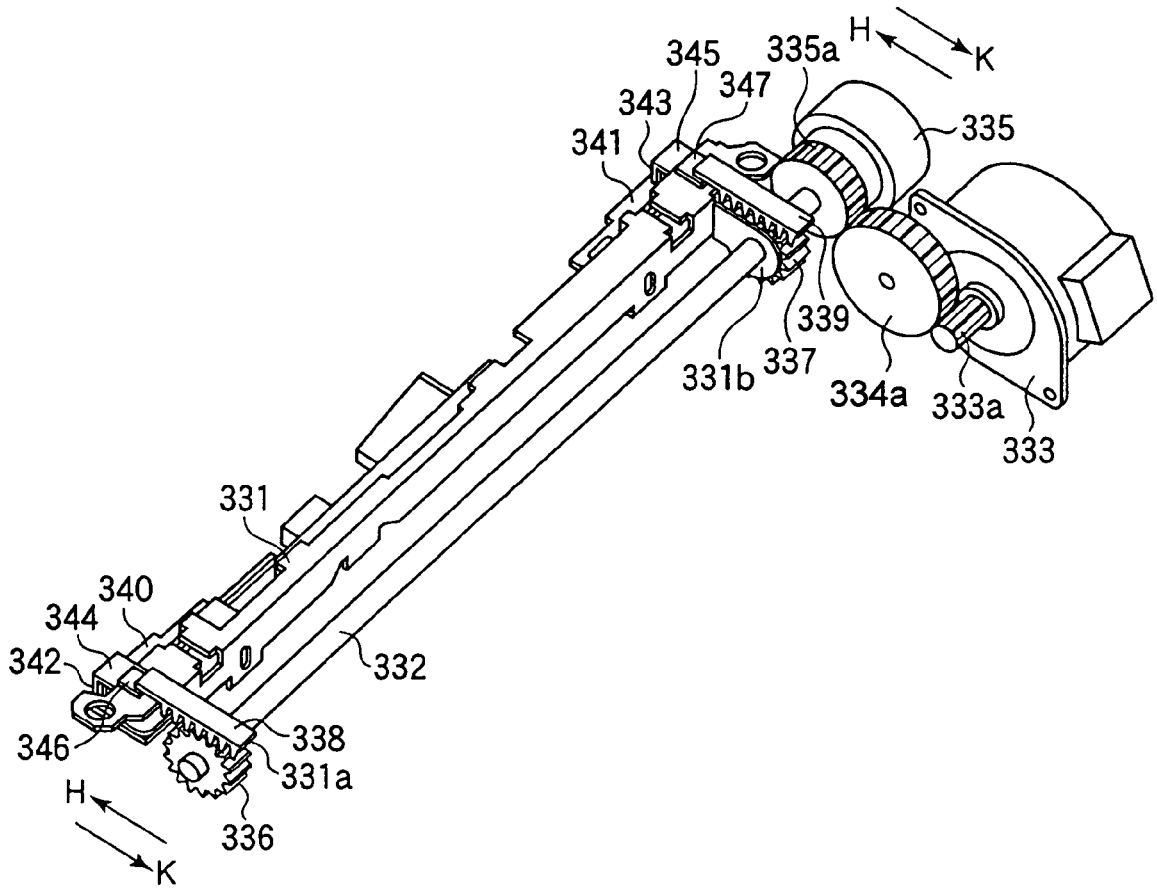
FIG. 19 is a perspective view of a pertinent portion of a third embodiment.

FIG. 19 is a perspective view of a pertinent portion of a third embodiment.

A shaft 332 is inserted rotatably into holes 331*a* and 331*b* formed in a supporting member 331 and has a left gear 336 and a right gear 337 attached to its opposed longitudinal end portions. An electromagnetic clutch 335 is provided to one end portion of the shaft 332. The electromagnetic clutch 335 has a gear 335*a* in mesh with an idle gear 334*a*, which in turn is in mesh with gear 333*a* of a motor 333.

The supporting member 331 has a left board 340 at one end portion thereof, the left board 340 carrying a color shift sensor 342 and a left sensor cover 344 thereon. The supporting member 331 has a right board 341 at another end thereof, the right board 341 carrying a color shift sensor 343 and a right sensor cover 345. The left gear 336 and right gear 337 are fixedly mounted to the opposed longitudinal end portions of the shaft 332. The left gear 336 is in mesh with a left rack 338 to which a left blade 346 is fixed and the right gear 337 is in mesh with a right rack 339 to which a right blade 347 is fixed. Guide members, not shown, guide the left rack 338 and right rack 339 so that they can slide in directions shown by arrows H and K.

When the image-forming apparatus is turned on, the motor 333 starts to rotate. Then, the electromagnetic clutch 335 is energized so that the gear 335*a* and shaft 332 are firmly interlocked with each other. Thus, the rotation of the motor 333 is transmitted via the gears 334*a* and 335*a* to the shaft 332, causing the left gear 336 and right gear 337 to rotate. The rotation of the left gear 336 and right gear 337 causes the left rack 338 and right rack 339 to slide in the H and K directions. Thus, the left blade 346 rubs the surface of the left sensor cover 344 and the right blade 347 rubs the right sensor cover 345. The forward rotation of the motor 333 causes the left blade 346 and right blade 347 to slide in one direction and the reverse rotation of the motor 333 causes the left blade 346 and right blade 347 to slide in the opposite direction.

The third embodiment employs the motor 333 in place of the solenoid 101 used in the second embodiment. This implies that the shutter in this embodiment may be driven to move by a drive force supplied from other motors. This configuration eliminates the need for the solenoid 101 of the first embodiment, thereby providing an inexpensive apparatus.

FOURTH EMBODIMENT

The image-forming apparatus according to the invention is equipped with a shutter and a mechanism (denoted at 30 in FIG. 1) for opening and closing the shutter.

Figure 20:
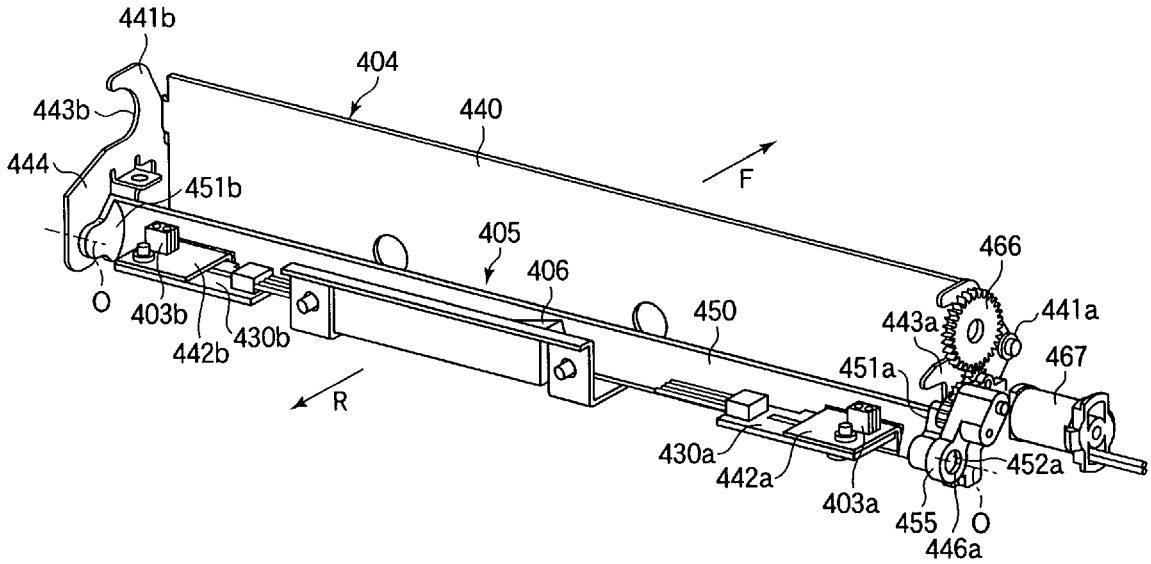
FIGS. 20 and 21 are a perspective view and an exploded view, respectively, illustrating a mechanism in FIG. 1 for opening and closing a shutter according to a fourth embodiment.
Figure 21:
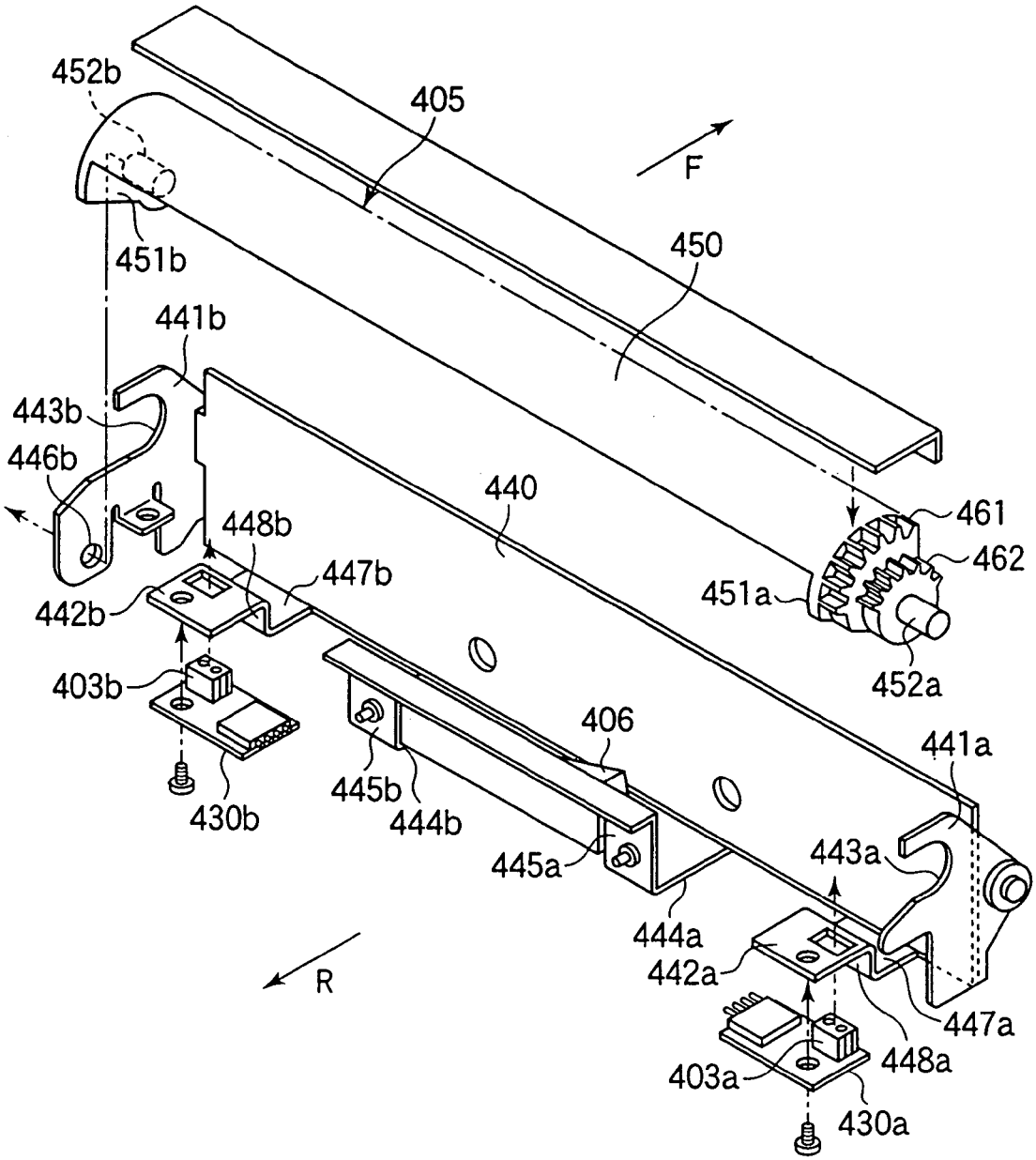

FIGS. 20 and 21 are a perspective view and an exploded view, respectively, illustrating the mechanism 30 for opening and closing the shutter according to a fourth embodiment.

Referring to FIG. 20, a frame 404 supports the color shift sensors 403*a* and 403*b* and has a long supporting plate 440 that extends in a direction parallel to the drive roller 25 (FIG. 1). The supporting plate 440 has a side plate 441*a* and a side plate 441*b* provided at opposed longitudinal ends of the supporting plate 440.

Referring to FIG. 21, the supporting plate 440 has bottom supports 447*a* and 447*b* that project rearward from opposing bottom end portions of the supporting plate 440. The bottom supports 447*a* and 447*b* include short upwardly extending portions 448*a* and 448*b*, respectively, and sensor supports 442*a* and 442*b* that project rearward from the top ends of the short upwardly extending portions 448*a* and 448*b*, respectively. The color shift sensors 403*a* and 403*b* are mounted on mounting plates 430*a* and 430*b*, respectively, with the detection surfaces of the sensors 403*a* and 403*b* facing upward. The mounting plates 430*a* and 430*b* are fixed by means of, for example, screws to the undersides of the sensor supports 442*a* and 442*b*, respectively, with the color shift sensors 403*a* and 403*b* projecting into holes formed in the sensor supports 442*a* and 442*b*, respectively.

The supporting plate 440 also has bottom supports 444*a* and 444*b* that are symmetrical about a longitudinal mid point of the supporting plate 440 and project rearward from the lower end of the supporting plate 440. The bottom supports 444*a* and 444*b* include short upwardly extending portions 445*a* and 445*b*. A density sensor 406 is supported on the bottom supports 444*a* and 444*b* and the short upwardly extending portions 445*a* and 445*b*.

Side plates 441*a* and 441*b* have roller-mounting portions 443*a* and 443*b*, respectively, by which the drive roller 25 (FIG. 1) is supported via bearings. The side plate 441*a* also supports a gear-supporting frame 455 (FIG. 20) thereon that holds a later described gear train.

Provided between the side plates 441*a* and 441*b* is a shutter 405 that covers the color shift sensors 403*a* and 403*b* and density sensor 406 when the color shift sensors 403*a* and 403*b* and density sensor 406 are not operated.

The shutter 405 includes a wall 450 and sector-shaped portions 451*a* and 451*b*. The wall 450 describes an arc about an axis and extends along a rotational axis of the drive roller 25. The sector-shaped portions 451*a* and 451*b* are formed at opposing longitudinal ends of the wall 450. The sector-shaped portions 451*a* and 451*b* substantially face the side plates 441*a* and 441*b*, respectively. The sector-shaped portions 451*a* and 451*b* have short shafts 452*a* and 452*b*, respectively. The shafts 452*a* and 452*b* are in line with the center of the sector-shaped portions 451*a* and 451*b*. The short shaft 452*a* extends into an engagement hole 446*a* (FIG. 20) formed in the gear-supporting frame 455 while the support 452*b* extends into an engagement hole 446*b* formed in the side plate 441*b*.

A configuration for opening and closing the shutter 405 will be described.

Figure 22A:
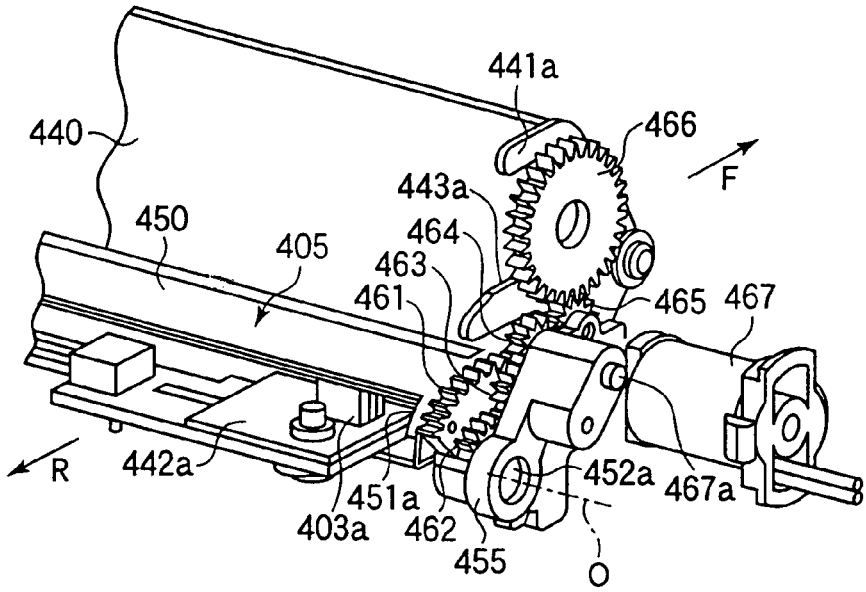
FIG. 22A is a perspective view, illustrating the mechanism for opening and closing the shutter when the shutter is at a closing position.

FIG. 22A is a perspective view, illustrating the mechanism 30 for opening and closing the shutter 405 when the shutter 405 is at a closing position.

Figure 22B:
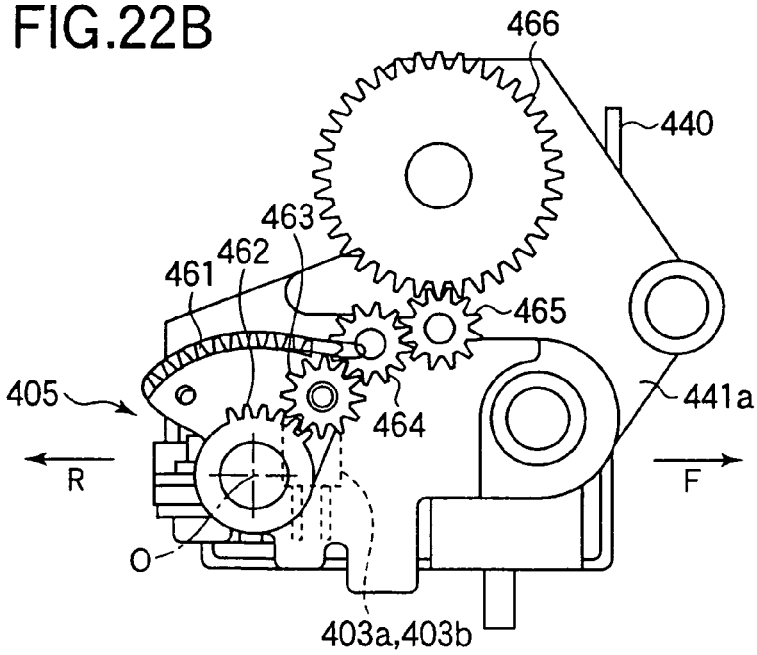
FIG. 22B is a side view of FIG. 22A.

FIG. 22B is a side view of FIG. 22A.

Figure 23A:
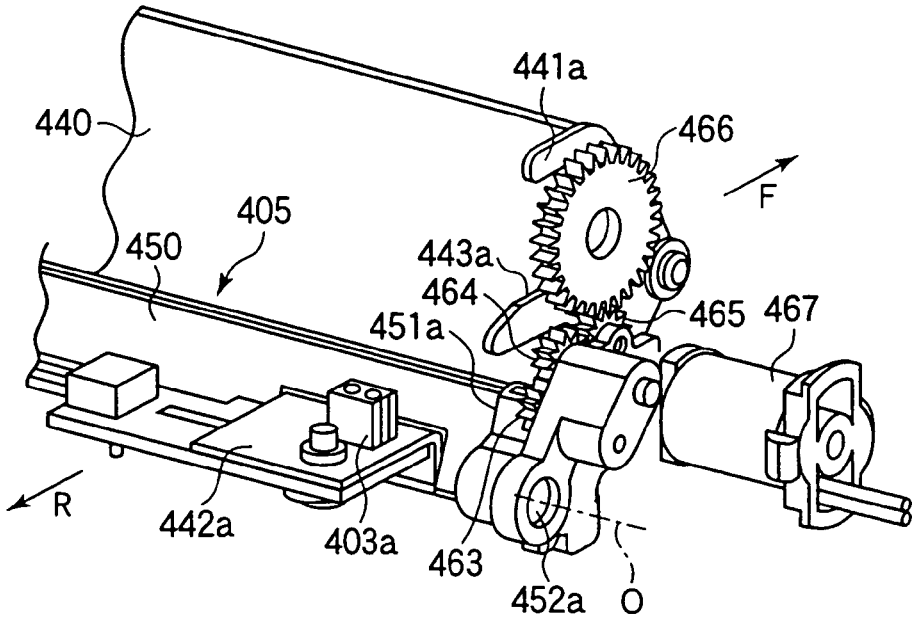
FIG. 23A is a perspective view, illustrating the mechanism for opening and closing the shutter when the shutter is at an opening position.

FIG. 23A is a perspective view, illustrating the mechanism 30 for opening and closing the shutter when the shutter 405 is at an opening position.

Figure 23B:
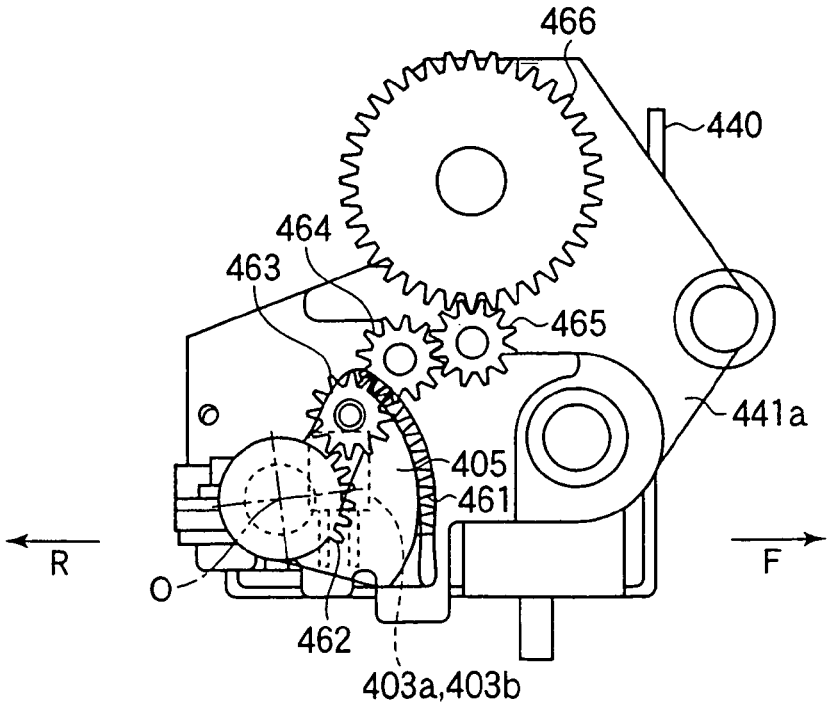
FIG. 23B is a side view of FIG. 23A.

FIG. 23B is a side view of FIG. 23A.

Referring to FIGS. 22A and 22B, when the shutter 405 is at the closing position, the wall 450 has extended to a position between the transfer belt 116 and the color shift sensors 403*a* and 403*b* and the density sensor 406 (FIG. 20). Referring to FIGS. 23A and 23B, when the shutter 405 is at the opening position, the wall 450 has retracted from the position between the transfer belt 116 and the color shift sensors 403*a* and 403*b* and the density sensor 406.

The drive force that drives the drive roller 25 is also used for rotating the shutter 405. Referring to FIG. 22A, the sector-shaped portion 451*a* of the shutter 405 has a first gear (sector gear) 461 formed in the arcuate periphery of the sector-shaped portion 451*a*. There is a second gear (sector gear) 462 in line with the first gear 461, the second gear 462 having a smaller diameter than the first gear 461. The first gear 461 and the second gear 462 are in line with the center axis O of the short shaft 452*a*.

Figure 22C:
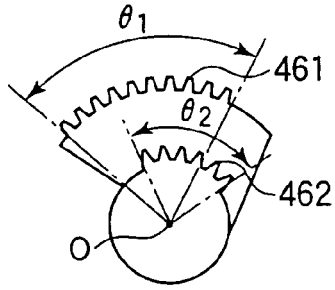
FIG. 22C illustrates the positional relationship between a first gear and a second gear.

FIG. 22C illustrates the positional relationship between the first gear 461 and the second gear 462.

As shown diagrammatically in FIG. 22C, the angle θ1 of the first gear 461 is substantially the same as the angle θ2 of the second gear 462. It is to be noted that the second gear 462 leads the first gear 461 in the clockwise direction in FIG. 22C.

As shown in FIG. 22B, the second gear 462 meshes with a third gear 463, rotatably supported on the gear-supporting frame 455. A fourth gear 464 is movable in a direction parallel to the axis O and selectively meshes with the first gear 461 and the third gear 463. The fourth gear 464 is securely attached to the end portion of a slide shaft 467*a*, made of a magnetic material, of a solenoid 467 in FIG. 22A. The fourth gear 464 meshes with a fifth gear 465, which is rotatably supported on the gear-supporting frame 455. The fifth gear 465 meshes with a sixth gear 466 mounted on a shaft of the drive roller 25. These gears 461–466 cooperate to transmit the rotation of the drive roller 25 to the shutter 405.

Figure 24A:
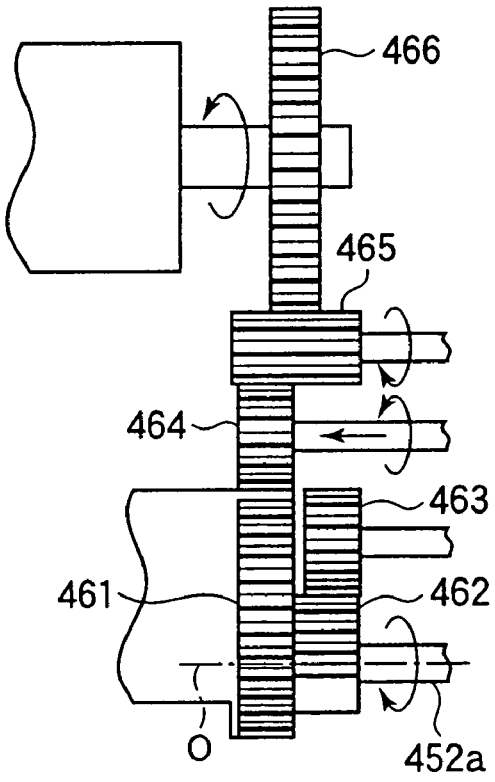
FIGS. 24A and 24B illustrate the operation of a gear train formed of gears.
Figure 24B:
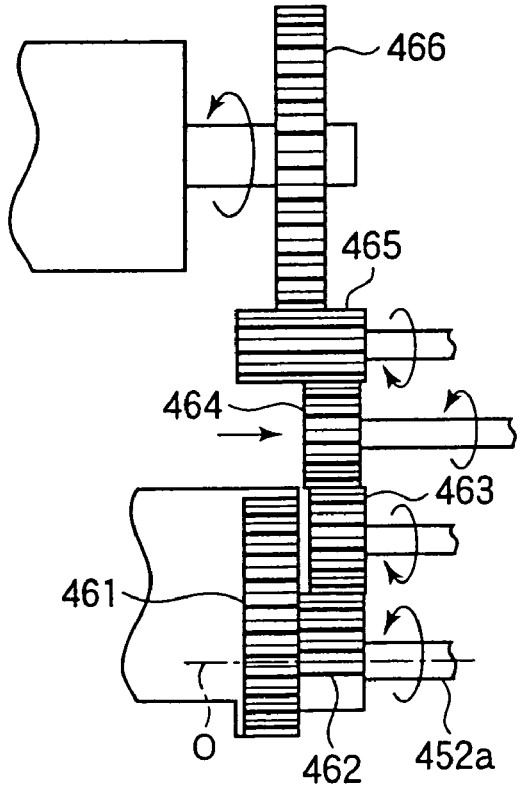

FIGS. 24A and 24B illustrate the operation of the gear train formed of the gears 461–466. As in FIG. 24A, when the fourth gear 464 is driven by the solenoid 467 to an extended position, the fourth gear 464 moves into meshing engagement with the first gear 461. At this moment, the rotation of the sixth gear 466 mounted on the drive roller 25 is transmitted to the first gear 461 through the fifth gear 465 and the fourth gear 464. As a result, the first gear 461 rotates in the opposite direction to the sixth gear 466, so that the shutter 405 rotates from the opening position to the closing position. When the fourth gear 464 is at its retracted position in FIG. 24B, the fourth gear 464 is in mesh with the third gear 463. At this moment, the rotation of the sixth gear 466 mounted to the drive roller 25 is transmitted to the second gear 462 through the fifth gear 465, the fourth gear 464, and the third gear 463. As a result, the first gear 461 rotates in the same direction as the sixth gear 466, so that the shutter 405 rotates from the closing position to the opening position.

When the shutter 405 rotates from the opening position to the closing position, the first gear 461 rotates until the first gear 461 moves out of meshing engagement with the fourth gear 464 as shown in FIG. 22B. With the first gear 461 being out of meshing engagement with the fourth gear 464, the rotation of the drive roller 25 is not transmitted to the shutter 405. However, the second gear 462 is in meshing engagement with the third gear 463. Therefore, when the fourth gear 464 moves to the retracted position where the fourth gear 464 meshes with the third gear 463, the rotation of the drive roller 25 is again transmitted to the shutter 405. When the shutter 405 rotates from the closing position to the opening position, the second gear 462 rotates until the second gear 462 moves out of meshing engagement with the third gear 463 as shown in FIG. 23B. Thus, the rotation of the drive roller 25 is not transmitted to the shutter 405. However, the first gear 461 is at a position where when the fourth gear 464 projects to the extended position, the fourth gear 464 can move into meshing engagement with the first gear 461. Thus, when the fourth gear 464 moves to the extended position into meshing engagement with the first gear 461, the rotation of the drive roller 25 is again transmitted to the shutter 405.

FIG. 25 is a block diagram, illustrating a control system for the image-forming apparatus.

The controller 412 of the image-forming apparatus is connected to the color shift sensors 403*a* and 403*b*, the density sensor 406, recording paper sensors 27*a*–27*d*, and a command/image processing section 411. The command/image processing section 411 processes the commands and image data received from an external computer through an interface 410. The controller 412 is connected to an LED controller 413, a high voltage controller 414, and a fixing heater 415, and controls these structural elements. The LED controller 413 controls LED heads 22 of the image-forming sections 2K, 2Y, 2M, and 2C. The high voltage controller 414 controls charging voltages, developing voltages, and transferring voltages for the image-forming sections 2K, 2Y, 2M, and 2C. The controller 412 controllably drives a fixing motor 416 that drives the fixing roller in rotation and a belt drive motor 417 that drives the drive roller 25 (FIG. 1) in rotation. The controller 412 controllably also drives a feed motor 418 that drives, for example, a feed roller 13 (FIG. 1) in rotation, and drum motors 419K, 419Y, 419M, and 419C that drive photoconductive drums of the image-forming sections 2K, 2Y, 2M, and 2C (FIG. 1) in rotation.

The operation of the image-forming apparatus of the aforementioned configuration will be described. After the image-forming apparatus is turned on, the developing unit 23 is replaced, or the transfer roller 24 is replaced, the controller 412 begins to energize the fixing heater 415 of the fixing roller 16*a*, and then performs signal processing in order to rotate the shutter 405 to the opening position.

In other words, the controller 412 drives the solenoid 467 to retract the fourth gear 464 to the retracted position as shown in FIG. 24B, causing the fourth gear 464 to mesh with the third gear 463. Then, the controller 412 drives the belt drive motor 417 (FIG. 25), causing the drive roller 25 (FIG. 1) to rotate. When the drive roller 25 rotates, the transfer belt 116 runs in the A direction (FIG. 1). Subsequently, the rotation of the sixth gear 466 mounted on the drive roller 25 is transmitted to the second gear 462 through the fifth gear 465, fourth gear 464, and third gear 463, so that the shutter 405 rotates from the closing position to the opening position. The controller 412 continues to drive the belt drive motor 417 in rotation after the shutter 405 has rotated to the opening position, so that the drive roller 25 continues to rotate.

After the shutter 405 has rotated to the opening position, the controller 412 performs color shift correction. That is, the controller 412 drives the LED controller 413 and the high voltage controller 414, so that the image-forming sections 2K, 2Y, 2M, and 2C form corresponding toner images for color shift detection sequentially. The toner images for color shift detection are transferred onto widthwise end portions of the transfer belt 116. Then, the color shift sensors 403*a* and 403*b* detect the patterns formed on the transfer belt 116. The reflection coefficients of a black pattern, a yellow pattern, a magenta pattern, and a cyan pattern are different from one another. For this reason, the color shift sensors 403*a* and 403*b* generate voltage signals having waveforms in accordance with the position and color of the patterns transferred onto the transfer belt 116. The controller 412 receives the voltage signals from the color shift sensors 403*a* and 403*b* to detect the amount of color shift of the respective patterns formed on the transfer belt 116 from the received voltage signals. Then, the controller 412 adjusts timings at which the image-forming sections 2K, 2Y, 2M, and 2C form corresponding toner images. In other words, the controller 412 adjusts the timing at which electrostatic latent images are formed. The controller 412 adjusts the positions and timings at which the respective LED heads 22 begin to illuminate the surfaces of photoconductive drums 20, thereby correcting the shift of the patterns of the respective colors both in the advancement direction and in the traversing direction.

After the color shift correction, the controller 412 performs an operation for rotating the shutter 405 to the closing position. As shown in FIG. 24A, the controller 412 drives the solenoid 467 to move the fourth gear 464 to the extended position where the fourth gear meshes with the first gear 461. Thus, the rotation of the sixth gear 466 mounted to the drive roller 25 is transmitted through the fifth gear 465 and the fourth gear 464 to the first gear 461 formed on the shutter 405, so that the shutter 405 rotates from the opening position to the closing position.

The density correction is performed, if required. For example, when an accumulated number of pages reaches a predetermined value, the density correction is performed. In the density correction, the controller 412 drives the LED controller 413 and the high voltage controller 414, thereby causing the image-forming sections 2K, 2Y, 2M, and 2C to form density detection patterns. Then, the transfer roller 24 transfers the density detection patterns onto a mid point of the width of the transfer belt 116. Then, the density sensor 406 detects the patterns formed on the transfer belt 116. The density sensor 406 generates a voltage signal having a waveform in accordance with the position and density of the density detection pattern formed on the transfer belt 116. In response to the voltage signal generated by the density sensor 406, the controller 412 sends commands to the image-forming sections 2K, 2Y, 2M, and 2C, the commands indicating adjustment of, for example, developing parameters.

After the shutter 405 has moved to the closing position, the controller 412 performs an image-forming operation in accordance with the commands from external computers. The controller 412 drives the fixing motor 416 and the belt drive motor 417 to cause the fixing roller 16*a* and the drive roller 25 to rotate. The controller 412 also drives the drum motors 419K, 419Y, 419M, and 419C to rotate the photoconductive drums 20, charging rollers 21, developing rollers 23*a*, and toner supplying rollers 23*b* of the respective image-forming sections. The controller 412 drives the feed motor 418 to cause the feed roller 13 to rotate, thereby advancing the recording paper P from the paper cassette 10. The recording paper P fed from the paper cassette 10 is advanced by the transport rollers pairs 14 and 15 and is electrostatically attracted to the transfer belt 116, which in turn carries the recording paper P in the A direction. The controller 412 drives the high voltage controller 414 to apply voltages to the charging rollers 21 and developing rollers 23*a* of the image-forming sections 2K, 2Y, 2M, and 2C.

When the leading edge of the recording paper P is advanced past a predetermined position, the controller 412 causes the command/image processing section 411 to send black image data to the LED head 22 of the image forming section 2K. In the image forming section 2K, the LED head 22 illuminates the photoconductive drum 20 to form an electrostatic latent image. The developing roller 23*a* applies toner to the electrostatic latent image to form a black toner image. When the leading edge of the recording paper P reaches above the transfer roller 24 of the image-forming section 2K, the high voltage controller 414 applies a transferring voltage to the transfer roller 24, thereby transferring the black toner image from the photoconductive drum 20 onto the recording paper P. Likewise, as the recording paper P passes through the image-forming sections 2Y, 2M, and 2C in sequence, the yellow, magenta, and cyan toner images are transferred onto the recording paper P in superposition.

After the recording paper P has passed through all the image-forming sections, the recording paper P advances to the fixing unit 16. When the recording paper P passes the nip between the fixing roller 16*a* and the pressure roller 16*b* in the fixing unit 16, the toner images are heated and pressurized so that the toner image is fused into a permanent image. After fixing, the recording paper P is driven by the discharge roller pairs 17 and 18 to the stacker 19.

As described above, in the fourth embodiment, the shutter 405 is opened only when the color shift sensors 403*a* and 403*b* operate to detect color shift and when the density sensor 406 operates to detect image density. This configuration reduces the chance of toner particles, which float within the image-forming apparatus, being deposited on the color shift sensors 403*a* and 403*b* and the density sensor 406, allowing reliable color shift correction and density correction.

Because the rotation of the drive roller 25 is used to open and close the shutter 405, there is no need for an exclusive drive source for opening and closing the shutter 405. Because it is only necessary for the solenoid 467 to generate a drive force for moving the fourth gear 464 straight (FIGS. 24A and 24B), the solenoid 467 can be of small power. Thus, the configuration prevents the image forming apparatus from increasing in size and cost.

While the fourth embodiment has been described with respect to a case in which the drive force of the belt drive motor 417 is used to move the shutter 405, the fixing motor 416 or other motors such as drum motors 419K, 419Y, 419M, and 419C may also be used. While the fourth embodiment has been described with respect to a configuration in which the toner images are transferred onto the transfer belt 116 that transports the recording paper P, other configurations may alternatively be employed. In the image forming apparatus of the intermediate transfer belt type, toner images are formed on the respective photoconductive drums, then transferred in superposition onto a belt in sequence, and finally the superposed toner images are transferred onto the recording paper simultaneously. In the intermediate transfer belt type, the toner images for color shift correction or density correction detection may be transferred onto the belt.

FIFTH EMBODIMENT

Figure 26:
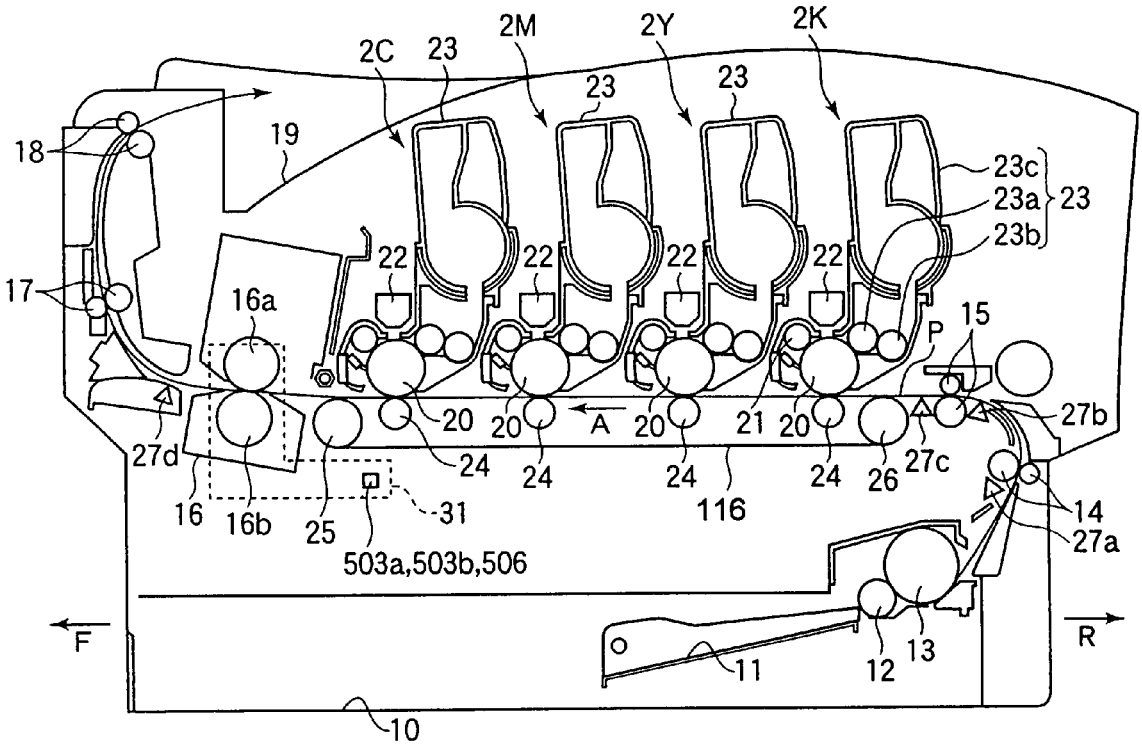
FIG. 26 illustrates a configuration of an image-forming apparatus according to a fifth embodiment.

FIG. 26 illustrates a configuration of an image-forming apparatus according to a fifth embodiment. Elements similar to or the same as those in FIG. 1 have been given the same reference numerals.

Referring to FIG. 26, the image-forming apparatus according to the fifth embodiment has a mechanism denoted at 31 for opening and closing the shutter 508. The mechanism 31 includes color shift sensors 503*a* and 503*b*, the shutter 508 for covering the color shift sensors 503*a* and 503*b*, and a drive mechanism for driving the shutter 508.

Figure 27:
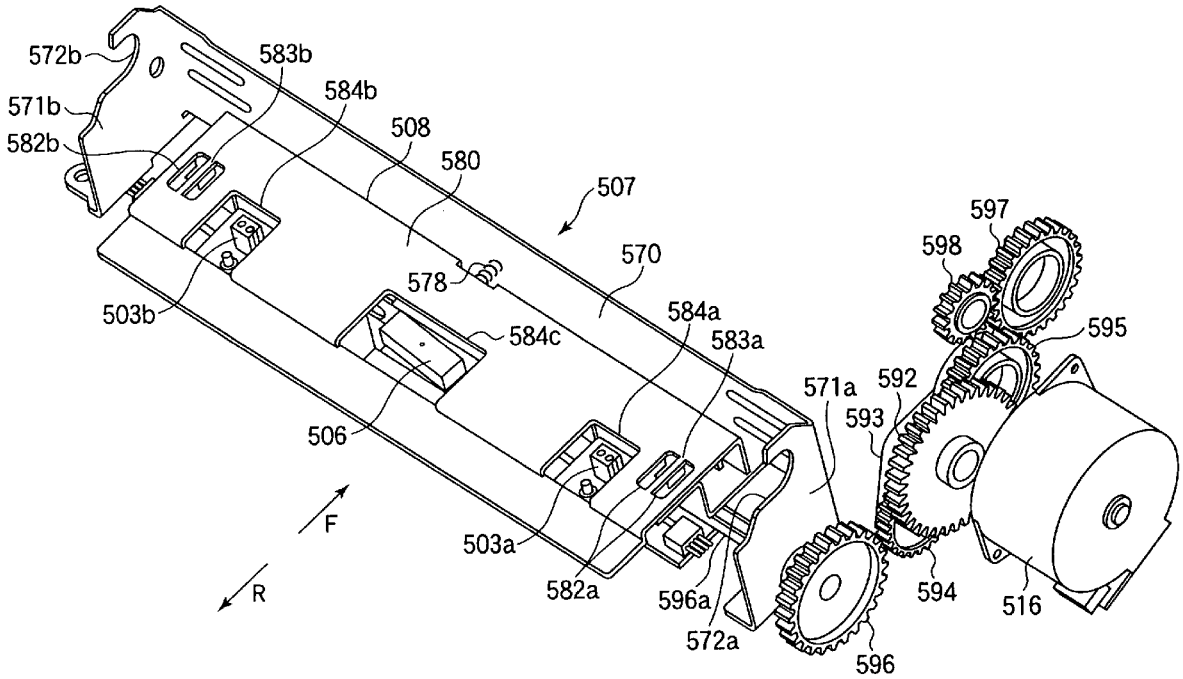
FIGS. 27–29 illustrate the mechanism (FIG. 26) for opening and closing the shutter.
Figure 28:
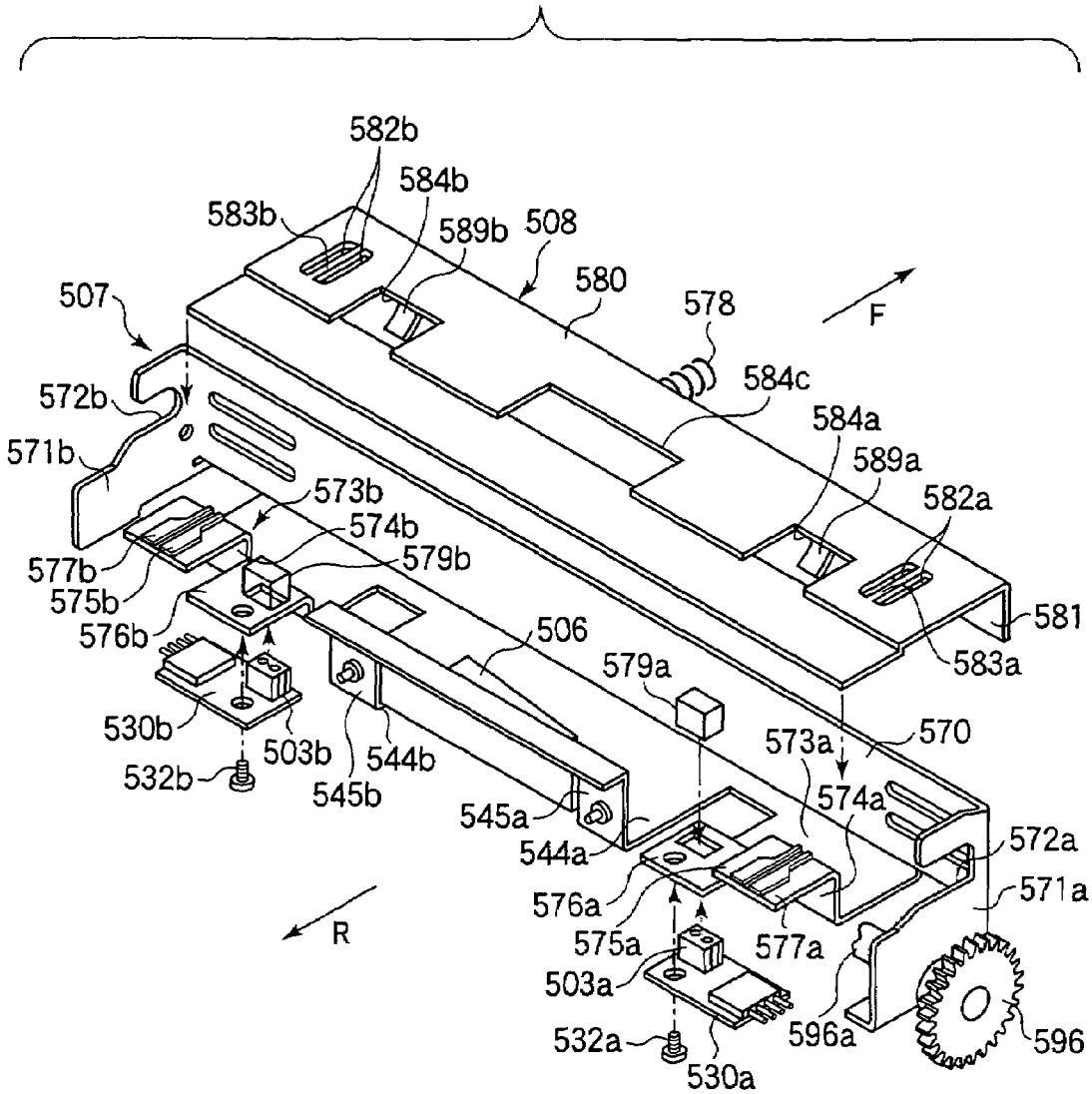
Figure 29:
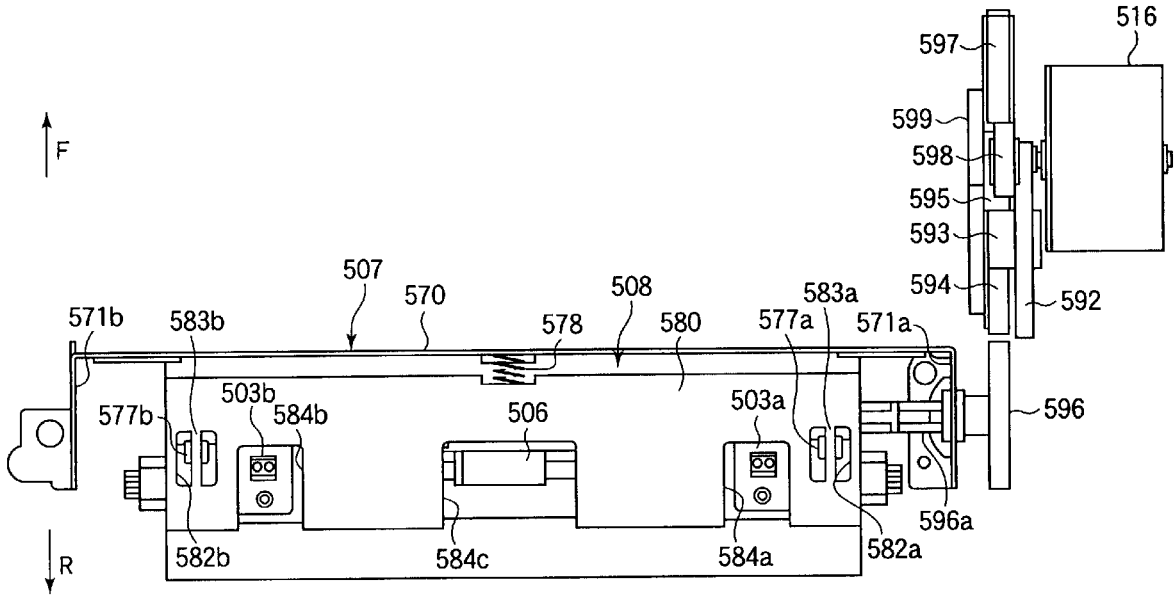

FIGS. 27–29 illustrate the mechanism 31 in FIG. 26. FIG. 27, FIG. 28, and FIG. 29 are a perspective view, an exploded perspective view, and a top view, respectively.

In the fifth embodiment, a frame 507 that supports the color shift sensors 503*a* and 503*b* and density sensor 506 has a supporting plate 570 that extends in a direction parallel to the axis of the drive roller 25 (FIG. 26). The supporting plate 570 has side plates 571*a* and 571*b* that extend rearward from the longitudinal opposing ends of the supporting plate 570. The side plates 571*a* and 571*b* have roller-mounting portions 572*a* and 572*b* formed therein, respectively, on which the drive roller 25 is supported via bearings, not shown.

As shown in FIG. 28, the supporting plate 570 has bottom supports 573*a* and 573*b* projecting rearward from longitudinal opposing bottom end portions of the supporting plate 570. The bottom supports 573*a* and 573*b* include short upwardly extending portions 574*a* and 574*b*, respectively, and shutter supports 575*a* and 575*b* that project rearward from the top ends of the short upwardly extending portions 574*a* and 574*b*, respectively. Sensor supports 576*a* and 576*b* are formed between the shutter supports 575*a* and 575*b*, the sensor support 576*a* being adjacent to the shutter support 575*a* and the sensor support 576*b* being adjacent to the shutter support 575*b*.

Just as in the fourth embodiment, the color shift sensors 503*a* and 503*b* are mounted with their detection surfaces facing up. The mounting plates 530*a* and 530*b* are fixed by means of screws 532*a* and 532*b* to the undersides of the sensor supports 576*a* and 576*b*, respectively, with the color shift sensors 503*a* and 503*b* projecting into holes formed in the sensor supports 576*a* and 576*b*, respectively. Upper surfaces and side surfaces of the color shift sensors 503*a* and 503*b* are covered with transparent covers 579*a* and 579*b*, which are made of acrylic resin and provided over the sensor supports 576*a* and 576*b*, respectively.

The supporting plate 570 has bottom supports 544*a* and 544*b* and short upwardly extending portions 545*a* and 545*b* that project upward from the bottom supports 544*a* and 544*b*, respectively. The density sensor 506 is supported on the bottom supports 544*a* and 544*b* and the upwardly extending portions 574*a* and 574*b*.

The shutter supports 575*a* and 575*b* support a shutter 508 thereon that covers the color shift sensors 503*a* and 503*b* and the density sensor 506. The shutter 508 extends in a direction parallel to the axis of the drive roller 25 and is bent into a substantially L-shape that includes a plate-like horizontal portion 580 and a downwardly extending portion 581. The plate-like horizontal portion 580 is supported on the shutter supports 575*a* and 575*b* and extends horizontal. The downwardly extending portion 581 extends downward from the horizontal portion 580. The horizontal portion 580 has openings 582*a* and openings 582*b* formed in longitudinal opposing end portions. A rail 583*a* is defined between openings 582*a* and another rail 583*b* is defined between openings 582*b*. The rails 583*a* and 583*b* engage guide members 577*a* and 577*b* formed in the shutter supports 575*a* and 575*b*, respectively, so that the shutter 508 is guided to slide back and forth. A compressed coil spring 578 is mounted between the supporting plate 570 and the downwardly extending portion 581 of the shutter 508 so as to urge the shutter 508 away from the supporting plate 570.

The horizontal portion 580 has substantially rectangular openings 584*a* and 584*b* formed close to and between the openings 582*a* and 582*b*, respectively. The horizontal portion 580 also has a substantially rectangular opening 584*c* formed in the longitudinal middle portion. When the shutter 508 is at the opening position (FIG. 29), the openings 584*a* and 584*b* are over the color shift sensors 503*a* and 503*b*, respectively, and the opening 584*c* is over the density sensor 506. When the shutter 508 moves in the R direction, the horizontal portion 580 of the shutter 508 covers the color shift sensors 503*a* and 503*b* and the density sensor 506.

Referring to FIG. 28, blades 589*a* and 589*b* are mounted near the openings 584*a* and 584*b*, respectively, so that the blades 589*a* and 589*b* can contact the upper surfaces of covers 579*a* and 579*b* of the color shift sensors 503*a* and 503*b*, respectively. The blades 589*a* and 589*b* are made of a resilient material such as silicone rubber. As the shutter 508 moves, the blades 589*a* and 589*b* move while being maintained in contact with the upper surfaces of the covers 579*a* and 579*b*, respectively, thereby removing foreign materials deposited on the covers 579*a* and 579*b*.

Figure 30A:
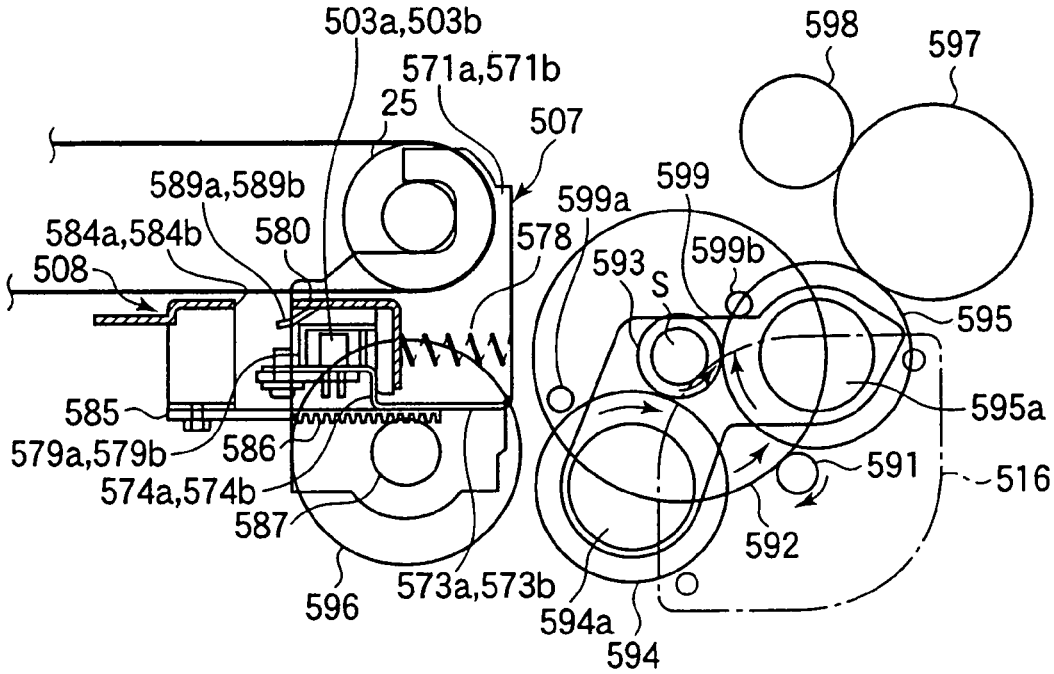
FIGS. 30A and 30B illustrate a drive system for opening and closing the shutter.
Figure 30B:
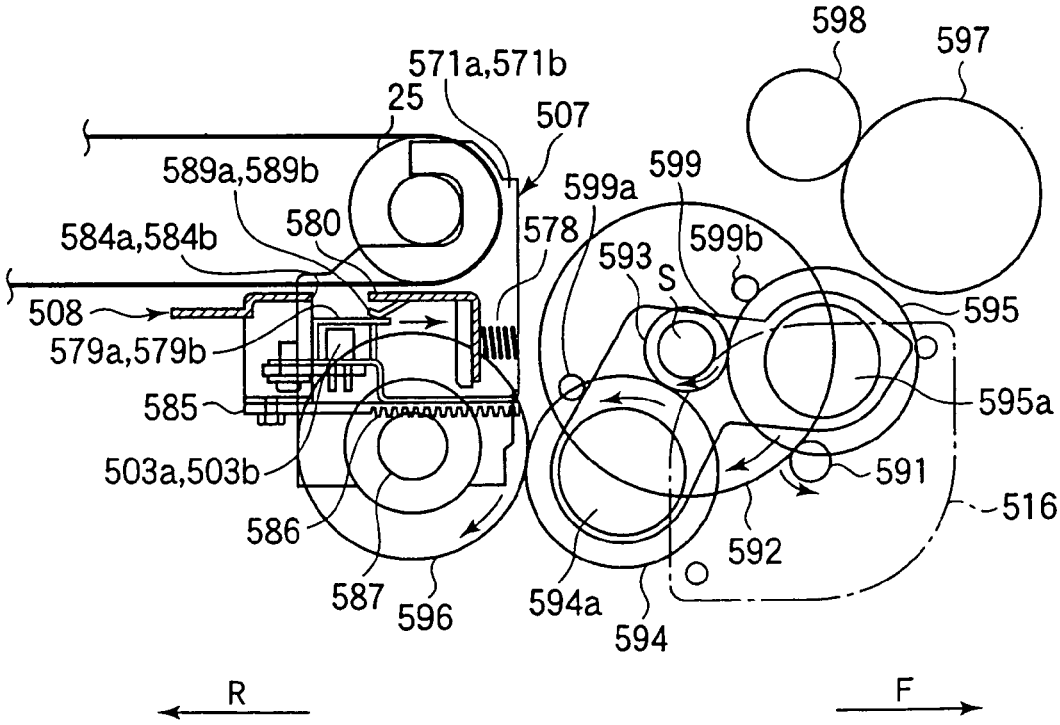

FIGS. 30A and 30B illustrate a drive system for opening and closing the shutter 508.

In FIGS. 30A and 30B, the gears are shown in pitch circles. Mounted at the bottom 585 of the shutter 508 is a rack 586 that extends in directions shown by arrows R and F. A pinion 587 is disposed under a frame 507 and is in mesh with the rack 586. A support member, not shown, is mounted on the frame 507 and supports the pinion 587 so that the pinion 587 is rotatable.

The shutter 508 is opened and closed by using a part of the drive force generated by the fixing motor 516 that drives the fixing roller 16*a*. A motor gear 591 is attached to the shaft of the fixing motor 516. A main gear 592 is in mesh with the motor gear 591. There is provided a small gear 593 formed in one piece with the main gear 592. The main gear 592 and small gear 593 are rotatably supported on a common shaft S. Movable gears 594 and 595 are supported on a lever 599 and are in mesh with the small gear 593. The lever 599 is in the shape of a boomerang. The shaft S extends through the middle portion of the lever 599 so that the lever 599 is rotatable about the shaft S. The lever 599 has shafts 594*a* and 595*a* at end portions thereof on which the movable gears 594 and 595 are supported, respectively. Stoppers 599*a* and 599*b* are provided to define a range in which the lever 599 pivots clockwise and counterclockwise about the shaft S.

Referring to FIG. 30A, when the fixing motor 516 rotates clockwise (forward rotation), the motor gear 591 mounted to the shaft of the fixing motor 516 also rotates clockwise. Thus, the main gear 592 in mesh with the motor gear 591 rotates counterclockwise. The small gear 593 in one piece with the main gear 592 also rotates counterclockwise. Through the meshing engagement of the small gear 593 with the movable gears 594 and 595 and the friction engagement of the gears 594 and 595 against the shafts 594*a* and 595*a*, the lever 599 pivots counterclockwise. A fixing-roller drive gear 597 drives the fixing roller 16*a* (FIG. 26) into rotation. When the lever 599 pivots counterclockwise, the movable gear 595 moves into meshing engagement with the fixing-roller drive gear 597. The fixing-roller drive gear 597 is in mesh with a drive gear 598 that drives the discharge roller pairs 17 and 18 in rotation.

When the fixing motor 516 rotates counterclockwise as shown in FIG. 30B, the motor gear 591 rotates counterclockwise, thereby causing the main gear 592 to rotate clockwise. The small gear 593 also rotates clockwise together with the main gear 592, causing the lever 599 to pivot clockwise. When the lever 599 pivots clockwise, the movable gear 594 moves into meshing engagement with a drive gear 596. The drive gear 596 is attached together with the pinion 587 to the shaft 596*a* (FIG. 28).

The operation of the image forming apparatus of the aforementioned configuration will be described with reference to FIG. 25 and FIGS. 30A and 30B.

After power-up or replacement of, for example, the developing unit 23, the controller 512 (FIG. 25) of the image-forming apparatus begins to heat the fixing heater 515 (FIG. 25) of the fixing roller 16*a*. Then, the controller 512 performs the operation in which the shutter 508 is moved from the closing position to the opening position.

As shown in FIG. 30A, the controller 512 drives the fixing motor 516 clockwise so that the lever 599 rotates counterclockwise to abut the stopper 599*b*. Then, the controller 512 drives the fixing motor 516 to rotate counterclockwise by a certain number of pulses as shown in FIG. 30B until the lever 599 pivots clockwise to abut the stopper 599*a*. As a result, the movable gear 594 moves into meshing engagement with the drive gear 596.

Through the meshing engagement of the drive gear 596 with the movable gear 594, the drive force of the fixing motor 516 is transmitted to the shutter 508 through the motor gear 591, main gear 592, small gear 593, movable gear 594, drive gear 596, pinion 587, and rack 586. A further counterclockwise rotation of the fixing motor 516 causes the shutter 508 to move forward (rightward in FIG. 30B) against the urging force of the coil spring 578. As a result, the openings 584*a* and 584*b* of the shutter 508 move to take up positions over the color shift sensors 503*a* and 503*b*. The opening 584*c* of the shutter 508 takes up the position over the density sensor 506.

The controller 512 controls the rotation of the fixing motor 516 in an open loop mode, which is based only on the number of motor pulses. The reason why the lever 599 is designed to first abut the stopper 599*b* is that the lever 599 should first be positioned at an initial position.

After the shutter 508 has moved to the opening position, the controller 512 performs the color shift correction just as in the fourth embodiment. While the color shift correction is being performed, the fixing motor 516 is not rotated.

After the color shift correction has been completed, the controller 512 performs the operation in which the shutter 508 is moved to the closing position. That is, the controller 512 drives the fixing motor 516 to rotate clockwise as shown in FIG. 30A. The urging force of the coil spring 578 causes the shutter 508 to move rearward (leftward in FIG. 30A). When the shutter 508 has moved to the closing position, the color shift sensors 503*a* and 503*b* and the density sensor 506 are covered with the shutter 508. At this moment, the coil spring 578 is completely relaxed so that no urging force acts between the drive gear 596 and the movable gear 594. Thus, the movable gear 594 moves out of meshing engagement with the drive gear 596 and the lever 599 pivots counterclockwise. Thus, the movable gear 595 moves into meshing engagement with the fixing roller drive gear 597, so that the fixing roller 16*a* and the discharge roller pairs 17 and 18 begin to rotate. Just as in the fourth embodiment, the density correction is performed as required.

As shown in FIGS. 30A and 30B, when the shutter 508 opens and closes, the resilient blades 589*a* and 589*b* mounted on the shutter 508 move while being maintained in contact with the upper surfaces of the transparent covers 579*a* and 579*b*. Thus, even if toner particles pass through the openings 584*a* and 584*b* of the shutter 508 and adhere to the transparent covers 579*a* and 579*b*, the blades 589*a* and 589*b* removes the toner particles.

The controller 512 performs the aforementioned operation in which the shutter 508 is opened and then closed, until the fixing heater 515 (FIG. 25) reaches a predetermined temperature (about 100° C.) after the fixing heater 515 is turned on. After the fixing heater 515 has reached a predetermined temperature, the fixing roller 16*a* continues to be rotated for a predetermined time length so that the fixing roller 16*a* is uniformly heated. Then, the image-forming operation is begun. In this manner, the image-forming operation begins promptly after the fixing heater 515 reaches a certain temperature.

As described above, in the fifth embodiment, the shutter 508 is opened only when the color shift sensors 503*a* and 503*b* operate for performing the color shift correction and when the density sensor 506 operates for performing the density correction. This configuration reduces the chance of toner particles, which float within the image forming apparatus, being deposited on the color shift sensors 503*a* and 503*b* and the density sensor 506, ensuring reliable color shift correction and density correction.

Because the shutter 508 is opened and closed by using the drive force of the fixing motor 516, there is no need for an exclusive drive source for opening and closing the shutter 508. Thus, the configuration prevents the image-forming apparatus from increasing in size and cost.

Additionally, the shutter 508 completes its opening and closing from when the fixing roller 16*a* begins to be heated until the fixing roller 16*a* reaches a predetermined temperature. Thus, the image-forming operation can be begun promptly where an image is formed on the recording paper P.

When the fixing motor 516 is rotating in one direction, the drive force of the fixing motor 516 is transmitted to the fixing roller 16*a*. When the fixing motor 516 is rotating in the opposite direction, the drive force of the fixing motor 516 is transmitted to the shutter 508. Simply switching the rotational direction of the fixing motor 516 allows directing of the drive force to different systems. Thus, the fifth embodiment eliminates a drive source (e.g. solenoid) for switching the direction in which the drive force is transmitted.

While the fifth embodiment has been described with respect to a case in which the drive force of the fixing motor 516 is used to drive the shutter 508, the belt drive motor 517 or other motors such as drum motors 519K, 519Y, 519M, and 519C may also be used. The fifth embodiment can be applied to an image-forming apparatus of the intermediate transfer type just as in the fourth embodiment.

SIXTH EMBODIMENT

Figure 31:
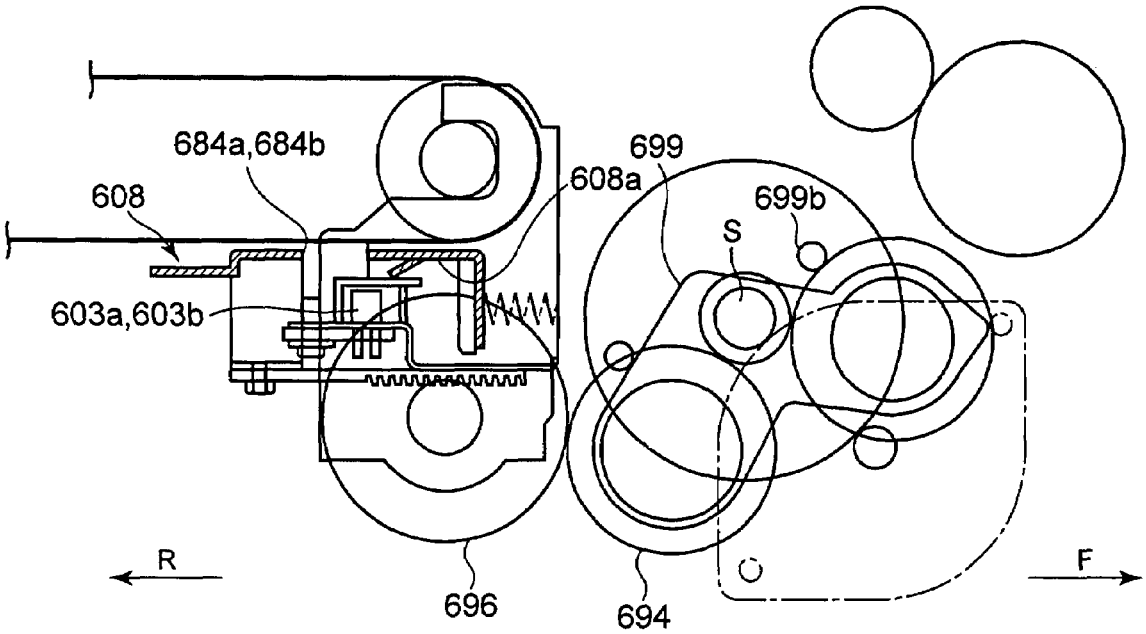
FIG. 31 illustrates the shutter and the configuration for opening and closing the shutter according to a sixth embodiment.

FIG. 31 illustrates a shutter 608 and the configuration for opening and closing the shutter 608, according to a sixth embodiment.

The sixth embodiment differs from the fifth embodiment in the control of the rotation of the fixing motor 616 (FIG. 25) when the shutter 608 is moved to the opening position. The rest of the configuration of the sixth embodiment is the same as the fifth embodiment.

In the sixth embodiment, the shutter 608 has a seal attached to its back surface, the seal having a reflection coefficient different from the surface of the transfer belt 116 (e.g., black). The seal may be, for example, a white seal. Thus, color shift sensors 603*a* and 603*b* (FIG. 25) generate outputs of different levels for a case in which the color shift sensors 603*a* and 603*b* face the back surface of the shutter 608 and a case in which the color shift sensors face the transfer belt 116. Thus, when the shutter 608 moves from the closing position to the opening position so that the perimeters of the openings 684*a* and 684*b* of the shutter 608 pass over the color shift sensors 603*a* and 603*b*, the outputs of the color shift sensors 603*a* and 603*b* change. From the changes in the outputs of the color shift sensors 603*a* and 603*b*, the controller 612 acknowledges that the perimeters of the openings 684*a* and 684*b* have passed the color shift sensors 603*a* and 603*b*. Then, the controller 612 drives the fixing motor 616 to rotate by a predetermined number of pulses.

According to the sixth embodiment, the rotation of the fixing motor 616 can be accurately controlled so that the shutter 608 is positioned at the opening position more accurately than when the rotation of the fixing motor 616 is controlled in an open loop mode.

When the fixing motor 616 is controlled in an open loop mode, a lever 699 requires to be first moved to an initial position (i.e., a position where the lever 699 abuts a stopper 699*b*). In the sixth embodiment, the lever 699 need not be moved to the initial position and therefore the shutter 608 can be moved in a short time.

When the fixing motor 616 is controlled in an open loop mode, the shutter 608 may stop at slightly different positions due to changes in friction load on a lever 699 and rattling when a movable gear 694 moves into meshing engagement with a drive gear 696. In order to ensure that the openings 684*a* and 684*b* are positioned over the color shift sensors 603*a* and 603*b* during color shift correction, the openings 684*a* and 684*b* should be made large to accommodate positional errors of the shutter 608. In the sixth embodiment, the controller 612 detects the shutter position when the shutter 608 moves past a predetermined position, and the rotation of the fixing motor 616 is controlled in response to the passage of the shutter 608. Therefore, the positional error of the shutter 608 can be very small, allowing the openings 684*a* and 684*b* to be relatively small. This configuration provides an advantage that toner is less likely to pass through the openings 684*a* and 684*b* to reach the color shift sensors 603*a* and 603*b* and a density sensor 606 (FIG. 25). The sixth embodiment may also be applicable to an intermediate transfer belt type apparatus.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus in which a toner image is formed on an image bearing body and the toner image is transferred onto a recording medium, comprising:

an image forming section;

a toner image bearing body;

a reading section that reads the toner image formed on said toner image bearing body;

a covering section provided between said reading section and said toner image bearing body and movable either to a closing position where said covering section covers said reading section or to an opening position where said covering section does not cover said reading section;

a drive mechanism that drives said covering section to move either to the opening position or to the closing position; and an adjustment section that adjusts said reading section when said covering section is at the closing position, said reading section being adjusted in such a way that an output of said reading section changes.

2. The image forming apparatus according to claim 1, further comprising a correction section that corrects at least one of a position on said toner image bearing body at which a toner image is formed and a density of the toner image formed on said toner image bearing body, the position and the density being corrected in accordance with an output of said reading section.

3. The image forming apparatus according to claim 1, wherein said covering section includes a reference sheet for adjusting said reading section, the reference sheet being positioned so that when said covering section is at the closing position, the reference sheet opposing said reading section;

wherein said adjustment section adjusts said reading section such that when said reading section reads the reference, and the output of said reading section is within a predetermined range.

4. The image forming apparatus according to claim 1, wherein said covering section includes a gray reference sheet for adjusting said reading section, the gray reference sheet being positioned so that when said covering section is at the closing position, the reference sheet opposing said reading section.

5. An image forming apparatus in which a toner image is formed on an image bearing body and the toner image is transferred onto a recording medium, comprising:

an image forming section;

a toner image bearing body;

a reading section that reads the toner image formed on said image bearing body;

a covering section provided between said reading section and said toner image bearing body and movable between a closing position where said covering section covers said reading section and an opening position where said covering section does not cover said reading section;

a drive mechanism that drives said covering section to move between the opening position and the closing position; and an adjustment section that adjusts said reading section when said covering section is at the closing position, wherein said covering section includes a reflection member attached thereto;

wherein said reading section includes a light emitting section that emits an amount of light to the reflection member and a light receiving section that receives light reflected from the reflection member; and wherein said adjustment section adjusts the amount of light in accordance with an output of the light receiving section that detects the reflection member.

6. The image forming apparatus according to claim 5, further comprising a controller that controls said drive mechanism to drive said covering section, the controller controlling said drive mechanism according to a detection output of the light receiving section that detects passage of an edge of said covering section;

wherein the reflection member has a first reflection coefficient and said toner image bearing body has a second reflection coefficient.

7. An image forming apparatus in which a toner image is formed on an image bearing body and the toner image is transferred onto a recording medium comprising:

an image forming section;

a toner image bearing body;

a reading section that reads the toner image formed on said image bearing body;

a covering section provided between said reading section and said toner image bearing body and movable between a closing position where said covering section covers said reading section and an opening position where said covering section does not cover said reading section;

a drive mechanism that drives said covering section to move between the opening position and the closing position;

an adjustment section that adjusts said reading section when said covering section is at the closing position;

a fixing section in which the toner image transferred onto the recording medium is fused into a permanent image; and at least one of a first drive section that drives said image forming section, a second drive section that drives said toner image bearing body, and a third drive section that drives said fixing section;

wherein said drive mechanism is powered by one of said first drive section, said second drive section, and said third drive section to move said covering section between the opening position and the closing position.

8. The image forming apparatus according to claim 7, wherein said drive mechanism drives said covering section to move straight.

9. The image forming apparatus according to claim 7, wherein said drive mechanism includes a gear train that transmits a drive force from any one of said first drive section, said second drive section, and said third drive section to said covering section.

10. The image forming apparatus according to claim 7, wherein said covering section moves in a first direction to the opening position and in a second direction opposite to the first direction to the closing position;

wherein when a rotating member of one of said first drive section, said second drive section, and said third drive section rotates in a third direction, said covering section moves either in the first direction or in the second direction.

11. The image forming apparatus according to claim 7, wherein said fixing section includes a heater, and said drive mechanism is powered by said third drive section to move said covering section to the opening position before the heater reaches a predetermined temperature.

12. The image forming apparatus according to claim 7, wherein said fixing section includes a motor;

wherein when the toner image is fused, the motor rotates in a forward direction; and wherein when said covering section moves to the opening position, the motor rotates in a reverse direction.

13. An image forming apparatus in which a toner image is formed on an image bearing body and the toner image is transferred onto a recording medium, comprising:

an image forming section;

a toner image bearing body;

a reading section that reads the toner image formed on said image bearing body;

a covering section provided between said reading section and said toner image bearing body and movable between a closing position where said covering section covers said reading section and an opening position where said covering section does not cover said reading section;

a drive mechanism that drives said covering section to move between the opening position and the closing position;

an adjustment section that adjusts said reading section when said covering section is at the closing position; and a cleaning member mounted to said covering section;

wherein when said drive mechanism drives said covering section to move between the opening position and the closing position, the cleaning member moves into contact engagement with said reading section to remove foreign matter from said reading section.

14. An image forming apparatus in which a toner image is formed on an image bearing body and the toner image is transferred onto a recording medium, the apparatus comprising:

an image forming section;

a toner image bearing body;

a reading section that reads the toner image formed on said toner image bearing body;

a covering section provided between said reading section and said toner image bearing body and movable between a closing position where said covering section covers said reading section and an opening position where said covering section does not cover said reading section;

a drive mechanism that drives said covering section to move between the opening position and the closing position; and an adjustment section that adjusts said reading section when said covering section is at the opening position, said reading section being adjusted with reference to a surface of said toner image bearing body on which a toner image is not formed.

15. The image forming apparatus according to claim 14, further comprising a correction section that corrects at least one of a position on said toner image bearing body at which a toner image is formed and a density of the toner image formed on said toner image bearing body, the position and the density being corrected in accordance with the output of said reading section.

16. The image forming apparatus according to claim 14, wherein said adjusting section adjusts said reading section in such a way that an output of said reading section changes.

17. The image forming apparatus according to claim 14, wherein said adjustment section adjusts said reading section so that an output of said reading section is within a predetermined range.

18. An image forming apparatus in which a toner image is formed on an image bearing body and the toner image is transferred onto a recording medium the apparatus comprising:

an image forming section;

a toner image bearing body;

a reading section that reads the toner image formed on said toner image bearing body;

a covering section provided between said reading section and said toner image bearing body and movable between a closing position where said covering section covers said reading section and an opening position where said covering section does not cover said reading section;

a drive mechanism that drives said covering section to move between the opening position and the closing position; and an adjustment section that adjusts said reading section when said covering section is at the opening position;

wherein said reading section includes a light emitting section that emits an amount of light to a reflection member and a light receiving section that generates an output in accordance with an amount of light received; and wherein said adjustment section adjusts the amount of light emitted from the light emitting section in accordance with the output of the light receiving section that detects light reflected by said toner image bearing body.

19. An image forming apparatus in which a toner image is formed on an image bearing body and the toner image is transferred onto a recording medium, the apparatus comprising:

an image forming section;

a toner image bearing body;

a reading section that reads the toner image formed on said toner image bearing body;

a covering section provided between said reading section and said toner image bearing body and movable between a closing position where said covering section covers said reading section and an opening position where said covering section does not cover said reading section;

a drive mechanism that drives said covering section to move between the opening position and the closing position;

an adjustment section that adjusts said reading section when said covering section is at the opening position;

a fixing section in which the toner image transferred onto the recording medium is fused into a permanent image; and at least one of a first drive section that drives said image forming section, a second drive section that drives said toner image bearing body, and a third drive section that drives said fixing section;

wherein said drive mechanism is driven by one of the first drive section, second drive section, and third drive section to open and close said covering section.

20. The image forming apparatus according to claim 19, wherein said drive mechanism drives said covering section to move straight.

21. The image forming apparatus according to claim 19, wherein said drive mechanism includes a gear train that transmits a drive force from any one of the first drive section, second drive section, and third drive section to said covering section.

22. The image forming apparatus according to claim 19, wherein said covering section moves in a first direction to the opening position and in a second direction opposite to the first direction to the closing position;

wherein when a rotating member of one of the first drive section, the second drive section, and the third drive section rotates in a third direction, said covering section moves either in the first direction or in the second direction.

23. The image forming apparatus according to claim 19, wherein said fixing section includes a heater;

said drive mechanism is powered by the third drive section to move said covering section to the opening position before the heater reaches a predetermined temperature.

24. The image forming apparatus according to claim 19, wherein said fixing section includes a motor;

wherein when the toner image is fused, the motor rotates in a forward direction; and wherein when said covering section moves, the motor rotates in a reverse direction.

25. An image forming apparatus in which a toner image is formed on an image bearing body and the toner image is transferred onto a recording medium, the apparatus comprising:

an image forming section;

a toner image bearing body;

a reading section that reads the toner image formed on said toner image bearing body;

a covering section provided between said reading section and said toner image bearing body and movable between a closing position where said covering section covers said reading section and an opening position where said covering section does not cover said reading section;

a drive mechanism that drives said covering section to move between the opening position and the closing position; and an adjustment section that adjusts said reading section when said covering section is at the opening position;

wherein a cleaning member is mounted to said covering section; and wherein when said drive mechanism drives said covering section to move between the opening position and the closing position, the cleaning member moves into contact engagement with said reading section to remove foreign matter from said reading section.

* * * * *